US011279531B2

(12) United States Patent
Savenok

(10) Patent No.: US 11,279,531 B2
(45) Date of Patent: Mar. 22, 2022

(54) BEVERAGE CAN CAP

(71) Applicant: Pavel Savenok, Wheaton, IL (US)

(72) Inventor: Pavel Savenok, Wheaton, IL (US)

( * ) Notice: Subject to any disclaimer, the term of this patent is extended or adjusted under 35 U.S.C. 154(b) by 61 days.

(21) Appl. No.: 16/791,062

(22) Filed: Feb. 14, 2020

(65) Prior Publication Data

US 2020/0262621 A1 Aug. 20, 2020

Related U.S. Application Data

(60) Provisional application No. 62/855,705, filed on May 31, 2019, provisional application No. 62/806,784, filed on Feb. 16, 2019.

(51) Int. Cl.

| | |
|---|---|
| ***B65D 51/00*** | (2006.01) |
| ***B65D 47/08*** | (2006.01) |
| ***B65D 43/02*** | (2006.01) |
| ***B65D 43/24*** | (2006.01) |

(52) U.S. Cl.

CPC ..... *B65D 51/007* (2013.01); *B65D 43/0212* (2013.01); *B65D 43/24* (2013.01); *B65D 47/08* (2013.01); *B65D 2251/0018* (2013.01); *B65D 2251/0028* (2013.01); *B65D 2251/0071* (2013.01)

(58) Field of Classification Search

CPC .. B65D 51/007; B65D 43/0212; B65D 43/24; B65D 47/08; B65D 2251/0018; B65D 2251/0028; B65D 2251/0071

USPC ..... 220/254.3, 253, 254.8

See application file for complete search history.

(56) References Cited

U.S. PATENT DOCUMENTS

| | | | | | |
|---|---|---|---|---|---|
| 4,938,379 | A * | 7/1990 | Kellner | B65D 25/48 | 220/370 |
| 5,054,640 | A * | 10/1991 | Tucker | B65D 51/243 | 220/716 |
| 5,269,432 | A * | 12/1993 | Beckertgis | B65D 47/265 | 215/250 |
| 6,073,797 | A * | 6/2000 | Barous | B65D 17/165 | 215/387 |
| 6,216,904 | B1 * | 4/2001 | Cagan | B65D 47/265 | 220/253 |
| 8,701,928 | B2 * | 4/2014 | Samson | A47G 19/2272 | 220/703 |
| 2003/0080130 | A1 * | 5/2003 | Goetz | B65D 17/401 | 220/253 |

(Continued)

*Primary Examiner* — J. Gregory Pickett
*Assistant Examiner* — Niki M Eloshway
(74) *Attorney, Agent, or Firm* — Christopher J. Scott

(57) ABSTRACT

A beverage can cap is outfitted upon an upper portion of a beverage can for enabling a user to selectively cover the upper portion. The upper can portion has an upper can rim and a can capping plate. The beverage can cap essentially includes an upper cap rim, a cap plate centrally located relative to the cap rim, and a cap opening.

The beverage can cap is attachable to the upper can portion of the beverage can such that the upper cap rim receives the upper can rim and the cap plate extends in parallel relation to the can capping plate. In certain embodiments, the beverage can cap is rotatable about a cap axis of rotation for selectively positioning the cap plate in superior adjacency to a beverage-letting aperture formable in the can capping plate for selectively covering the beverage-letting aperture with a portion of the cap plate.

18 Claims, 42 Drawing Sheets

(56) References Cited

U.S. PATENT DOCUMENTS

| | | | | |
|---|---|---|---|---|
| 2003/0222083 | A1* | 12/2003 | Pladsbjerg | B65D 17/4012 220/254.3 |
| 2010/0133275 | A1* | 6/2010 | Phillips | B65D 47/286 220/270 |
| 2015/0041480 | A1* | 2/2015 | Ramsey | B65D 25/2817 220/758 |
| 2019/0168932 | A1* | 6/2019 | Jevtic | B65D 51/18 |
| 2020/0317395 | A1* | 10/2020 | Bayona Salazar | B67B 7/40 |

* cited by examiner

BEVERAGE CAN CAP

PRIOR HISTORY

This application claims the benefit of (1) pending U.S. Provisional Patent Application No. 62/806,784 filed in the United States Patent and Trademark Office (USPTO) on 16 Feb. 2019, and (2) pending U.S. Provisional Patent Application No. 62/855,705 filed in the USPTO on 31 May 2019, the specifications and drawings of which provisional applications are hereby incorporated by reference thereto.

FIELD OF THE INVENTION

The present invention relates generally to cap formation for outfitting a beverage can. More particularly, the present invention relates to a beverage can cap as variously exemplified for attachment to an upper can portion of a beverage can for covering a beverage-letting aperture formed in the upper can portion and/or for controlling beverage flow through the beverage-letting aperture.

BRIEF DESCRIPTION OF THE PRIOR ART

The prior art perceives a need for a low cost, unibody, thermoformed beverage can cap for outfitting an upper portion of a beverage can and enabling a user to selectively cover the upper can portion for preventing contaminants from freely entering the otherwise open beverage can and further for controlling beverage flow from an open beverage can. The present invention attempts to address this perceived need by providing certain low cost, unibody, thermoformed beverage can caps as summarized in more detail hereinafter.

SUMMARY OF THE INVENTION

Among the many objectives of this invention is the provision of a beverage can cap as variously exemplified for outfitting a beverage can and enabling a user thereby to selectively cover an upper can portion of the beverage can and/or to control beverage flow from a beverage can as outfitted with the various beverage can caps. The upper can portion of the beverage can usable in combination with the beverage can cap(s) according to the present invention is believed to essentially comprise an upper can rim, a can capping plate, and a (frustoconical) can neck portion.

A first alternative beverage can cap according to the present invention preferably comprises a lower cap skirt, an upper cap rim, a cap plate centrally located relative to the cap rim, and a cap opening formed in the cap plate. The first alternative beverage can cap is removably and rotatably attachable to the upper can portion of the beverage can such that the upper cap rim receives the upper can rim, the cap plate extends in parallel relation to the can capping plate and the lower cap skirt seats down upon the can neck portion. The first alternative beverage can cap is rotatable about a cap axis of rotation for selectively positioning the cap plate in superior adjacency to a beverage-letting aperture formable in the can capping plate for selectively covering the beverage-letting aperture with a portion of the cap plate.

The frustoconical can neck portion may extend obliquely relative to the can capping plate in various beverage cans. The lower cap skirt may preferably extend obliquely relative to the cap plate such that the lower cap skirt parallels the can neck portion. The frustoconical can neck portion comprises an upper neck portion and a lower neck portion. The lower cap skirt is contemplated to preferably comprise a skirt edge that terminates downwardly intermediate the upper and lower neck portions for enhancing safe use of the beverage can cap during cap rotation, for example, by preventing any sharp edge portions of the lower skirt edge from directly contacting or engaging the user's hands during cap-turning movements or actions.

The first alternative beverage can cap may further preferably comprise at least one, but preferably a series of circumferentially spaced cap-turning nubs for enhancing a user's ability to rotate the first alternative beverage can cap relative to the beverage can. Further, the first alternative beverage can cap may further preferably a flange-like grip formation for enabling the user to more easily remove the first alternative beverage can cap from the beverage can. The flange-like grip formation may be preferably aligned with a select cap-turning nub as exemplified by a posterior-most nub.

The first alternative beverage can cap may further optionally comprise a stopper feature. The stopper feature extends downwardly relative to the cap plate for engaging a select aperture edge of the beverage-letting aperture for preventing cap-to-can rotation past maximum open and maximum closed cap-to-can positions. The first alternative beverage can cap may further preferably comprise a raised tab element cover, which raised tab element cover extends upwardly from the cap plate and is dimensioned for interiorly receiving a can-opening tab element and exteriorly providing the user with visual alignment aid for aligning the first alternative beverage can cap relative to the can-opening tab element.

A second alternative beverage can cap according to the present invention preferably comprises an upper cap rim, a cap plate centrally located relative to the cap rim, a cap opening formed in the cap plate, and a cap plug. As with the first alternative beverage can cap, the second alternative beverage can cap is removably and rotatably attachable to the upper can portion of the beverage can such that the upper cap rim receives the upper can rim and the cap plate extends in parallel relation to the can capping plate. The rotatability of the second alternative beverage can cap is of secondary importance given the inclusion of the cap plug feature.

Nevertheless, the second alternative beverage can cap is rotatable about a cap axis of rotation for selectively positioning the cap plate and the cap plug in superior adjacency to a beverage-letting aperture formable in the can capping plate for selectively covering the beverage-letting aperture with a portion of the cap plate. The cap plug of the second alternative beverage can cap functions to selectively plug the beverage-letting aperture and the cap opening. The cap plug is preferably pivotally attached to the raised tab element cover and removably retainable thereby via the mated engagement of certain elements formed in the second alternative beverage can cap.

A third alternative beverage can cap according to the present invention preferably outfits a beverage can for essentially enabling a user to resiliently control beverage flow from the beverage can. The third alternative beverage can cap according to the present invention preferably comprises an upper cap rim, a cap plate centrally located relative to the cap rim, and a resilient beverage-letting mechanism coextensively formed with the cap plate.

The third alternative beverage can cap is attachable to an upper can portion of the beverage can such that the upper cap rim receives an upper can rim and the cap plate extends in parallel relation to a can capping plate. The resilient beverage-letting mechanism is resiliently actuable for forming a beverage-letting gap and relaxable/resiliently returnable for closing the beverage-letting gap. The resilient beverage-letting mechanism thus enables the user to control beverage flow via the beverage-letting gap from the beverage can as outfitted with the third alternative beverage can cap.

The third alternative beverage can cap according to the present invention also preferably comprises a tab element cover, which tab element cover extends upwardly from the cap plate and is dimensioned for interiorly receiving and covering a can-opening tab element. The tab element cover may preferably comprise a tab-engaging protrusion, which tab-engaging protrusion is insertable into a tab element aperture formed in the underlying can-opening tab element for securing the tab element cover to the can-opening tab element.

The tab element cover of the third alternative beverage can cap according to the present invention may be of either a fixed or stationary (i.e. uncut) form as is the case with the first alternative beverage can cap or of a pivotal (cut on three sides) form that translates in unison with the underlying can-opening tab element. It is further contemplated that the tab element cover of the third alternative embodiment may be provided with a perforated outer edge (or otherwise outfitted with a notched outer perimeter or edge) for enabling the user to break the perforation if desired by the user by pulling up on the outer peripheral edge.

In the former case scenario, the user may open the targeted beverage can (as the user would in connection with the first alternative beverage can cap) and attach the third alternative embodiment for selectively covering the beverage-letting aperture and/or controlling beverage flow from the beverage can. The third alternative beverage can cap, however, preferably comprises a tab element cover as shown in the appended drawings (i.e. cut on three sides and hinged). In this latter case scenario, there is no need to remove the third alternative beverage can cap from the beverage can to open the beverage can. The beverage can may be opened with the third alternative beverage can cap as outfitted thereupon.

The resilient beverage-letting mechanism is preferably pivotally attached to the cap plate via laterally opposed living hinge mechanisms or hinges. The laterally opposed living hinges enhance resilient action of the beverage-letting mechanism. All beverage can caps according to the present invention preferably further comprise an inwardly extending cap groove for engaging or cooperating with a can groove. The can groove is positioned in inferior adjacency to the upper can rim as part of the beverage can formation process. The inwardly extending cap groove(s) are structurally cooperable with the can groove for enhancing cap-to-can attachment.

Other secondary objects of the present invention, as well as particular features, elements, and advantages thereof, will be elucidated or become apparent from, the following brief descriptions of the drawings and the accompanying drawing figures.

BRIEF DESCRIPTIONS OF THE DRAWINGS

Other features and objectives of the invention will become more evident from a consideration of the following brief descriptions of patent drawings.

DETAILED DESCRIPTION OF THE PREFERRED EMBODIMENTS

Figure 2:
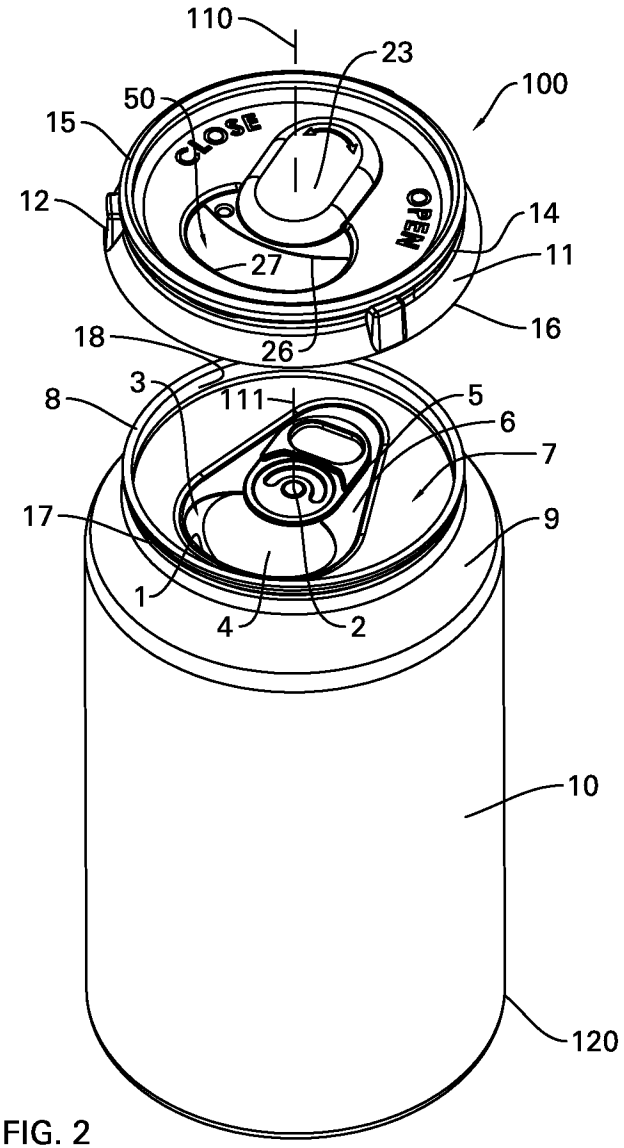
FIG. 2 is an exploded top perspective view of a generic beverage can and the first beverage can cap according to the present invention showing the first beverage can cap exploded from the beverage can in a rotatably open position relative to the generic beverage can.

Referring now to the drawings with more specificity, the following specifications generally describe a beverage can cap as variously exemplified, including (a) beverage can cap 100 as generally illustrated and referenced in FIGS. 1-19; (b) beverage can cap 200 as generally illustrated and referenced in FIGS. 20-27A; and (c) beverage can cap 300 as generally illustrated and referenced in FIGS. 28-41B. All of the beverage can caps 100, 200, and 300 according to the present invention are preferably formed of a low cost, unibody thermoplastic material construction through a thermoform molding process and have an inherent material resiliency.

All of the beverage can caps 100, 200, and 300 according to the present invention are further designed to be attached to an upper can portion of a state of the art beverage can or drink can for enabling the user or beverage consumer to cover an otherwise open beverage can to prevent contaminants from entering the open beverage can, and to provide the user or beverage consumer with an added ability to control beverage or liquid flow from the outfitted beverage can. A generic beverage can usable in combination with the beverage can caps 100, 200, and 300 is generally illustrated and referenced at 120 throughout the drawings submitted in support of these specifications.

The reader will note that cap rotation relative to the beverage can 120 applies only to the first and second embodiments or beverage can caps 100 and 200. The third embodiment or beverage can cap 300 is preferably designed to tightly grip the upper can portion with little to no possibility for cap rotation or removability relative to the beverage can 120. The third embodiment or beverage can cap 300 is primarily designed to be part of 4-pack or 6-pack packaging arrangement and thus a tight, non-rotatable cap-to-can attachment is important.

The beverage can caps 100, 200, and 300 according to the present invention are designed for providing the user or consumer with low cost means for selectively covering a beverage can and may thus be considered re-closable caps for cans designed to be applied on top of a beverage can that contain exemplary consumable liquids such as soda or beer and sold as sealed by the manufacturer in a packaged state. All of the beverage can caps 100, 200, 300 according to the resent invention can be attached to an upper can portion after opening the beverage can by the user or servicer, although it is contemplated that beverage can cap 300 is preferably attached to the upper can portion by the manufacturer or supplier to be sold to consumers with the beverage can cap 300 already installed.

The beverage can caps 100 and 200 may both be snapped on top of the beverage can and used as an opening and closing device during the time of consumption by the beverage consumer. The beverage can caps 100 and 200 may also be snapped onto the upper can portions by the manufacturers or establishments that sell the canned products. In this latter case scenario, the user may first remove the beverage can caps 100 and 200 from the pre-outfitted beverage cans 120, then open selected beverage can(s) 120, and then reattach the respective beverage can caps 100 and 200 to the upper can portion of the selected beverage can(s).

As noted hereinabove, the third embodiment or beverage can cap 300 is preferably designed to tightly grip the upper can portion with little to no possibility for cap rotation or removability relative to the beverage can 120, although it is also contemplated that the third embodiment or third alternative beverage can cap 300 may be formed with a fixed or stationary tab element cover 39, in which case cap rotation and removability is more necessary.

In some instances, it is contemplated that the respective beverage can caps 100, 200, or 300 may be used as a temporary cap for a partially used or consumed canned product. For example, the user may elect to open a beverage can 120 and proceed to use/consume only half of the consumable product. In order to prevent contaminants from entering the open beverage can 120, and to keep the unused/unconsumed product somewhat protected, the user or beverage consumer may proceed to attach one of the respective beverage can caps 100, 200, or 300 to the upper can portion of the beverage can 120 and place the same back into a refrigerator, for example. It is contemplated that the present invention is not limited only to canned products such as soda, beer, coffee, tea etc., but also as a temporary capping mechanism with any canned product such as corn, peas, soup, chili, etc.

State of the art beverage or drink cans embraced by the illustrated generic beverage can 120, usable in combination with the presently described beverage can caps 100, 200, and 300, are typically metallic containers designed to hold a fixed portion of liquid such as carbonated soft drinks, alcoholic drinks, fruit juices, teas, herbal teas, energy drinks, etc. Typically, the beverage or drink cans that may be outfitted with the beverage can caps 100, 200, 300 according to the present invention are constructed from aluminum or tin-plated steel and comprise a can body as at 10, an upper can rim as at 8, a can capping plate as at 7, and a can opener or can tab assembly. A can groove 17 typically extends in inferior adjacency to the upper can rim 8. After the beverage can is trimmed, it is typically bent and seamed to secure the can lid assembly after the can body 10 is filled. A can groove 17 is a typical structure feature of the beverage can 120 for product-filled/sealed beverage cans.

The can capping plate 7 is centrally located relative to the can rim 8 and extends in a can capping plate plane as at 113. The can opener or tab assembly is centrally located relative to the can capping plate 7 and preferably comprises a lever-like can-opening tab element as at 5 and a fulcrum-like opener pin or rivet as at 2. The opener pin or rivet 2 provides a turning center of the can-opening tab element 5 and fixes/fastens the can-opening tab element 5 to the can capping plate 7. Notably, the can-opening tab element 5 may rotate about a can axis as at 111. The beverage cap can 100 comprises a cap axis of rotation 110 that is preferably coaxial with the can axis 111.

The can-opening tab element 5 preferably comprises a first lever-like opener end as at 116 and a second lever-like opener end as at 117. The opener pin or rivet 2 is located intermediate the first and second opener ends 116 and 117 rotatably and pivotally attaching the can-opening tab element 5 to the can capping plate 7 thereby providing a fulcrum mechanism. The first lever-like opener end 116 is manually operable (liftable) by the user for directing a can-opening force into the (substantially rigid) can-opening tab element 5 from the user. The second lever-like opener end 117 is pivotable about the fulcrum mechanism for engaging the can capping plate 7 and directing the can-opening force into the can capping plate 7 for forming a beverage-letting aperture as at 3 in the can capping plate 7 by depressing a scored plate portion 4.

In this regard, a perforated or scored plate portion 4 is (partially) separated from the can capping plate 7 via the can-opening force directed thereinto via the second lever-like opener end 117 and forms a beverage-letting aperture 3 with aperture edging as at 1. The scored plate portion 4 extends in the capping plate plane 113 as optionally offset within a tab-accommodating recessed portion, depression or indentation as at 6. The can body 10 of the beverage can 120 may further preferably comprise a frustoconical can neck portion 9 in inferior adjacency to the upper can rim 8. The frustoconical can neck portion 9 extends in a neck portion plane as at 115, which neck portion plane 115 extends obliquely relative to the can capping plate plane 113. The can body 10 essentially functions to contain beverage as generally depicted and referenced at 102. The beverage 102 is consumable by the user via beverage or liquid egression or liquid flow 108 via the beverage-letting aperture 3.

The first alternative beverage can cap 100 according to the present invention preferably comprises a lower cap skirt as at 11; an upper cap rim as at 15; an inwardly extending cap groove 14 intermediate the lower cap skirt 11 and the upper cap rim 15; a cap plate as at 20 centrally located relative to the upper cap rim 15 generally extending in a cap plate plane 112; a cap opening as at 50; and a tab cover feature as at 23.

The lower cap skirt 11 preferably comprises an outer skirt edge 16; at least one, but preferably a series of circumferentially spaced cap-turning nubs as referenced at 12; and at least one flange-like grip formation as referenced at 13. It is contemplated that the grip formation 13 is preferably aligned with a select cap-turning nub 12, as exemplified by the posterior-most cap-turning nub 12. The cap-turning nubs 12 are designed to be manually operable by the user for rotating the beverage can cap 100 about the cap axis of rotation 110.

The beverage can cap 100 is removably and rotatably attachable to the upper can portion or lid portion of the beverage can 120 such that the cap rim 15 receives the upper can rim 8; the cap plate portion 20 extends in parallel relation to the can capping plate 7; the cap opening 50 may be preferably and rotatably positioned in superior adjacency to or in alignment with the beverage-letting aperture 3 when in a cap-open configuration; and the inwardly extending cap groove 14 resiliently engages and is thus cooperable with the can groove 17 via the inherent resiliency of the material construction for enhancing cap-to-can attachment.

The raised tab element cover feature 23 extends upwardly from the cap plate portion 20 and is dimensioned for inferiorly or interiorly receiving the can-opening tab element 5 and superiorly or exteriorly providing the user with visual alignment aid for aligning the beverage can cap 100 relative to the can-opening tab element 5. The lower cap skirt 11 seats down upon the frustoconical can neck portion 9 such that a skirt plane 114 of the lower cap skirt 11 extends in parallel relation to the neck portion plane 115.

The beverage can cap 100 is rotatable about the cap axis of rotation 110 for selectively positioning closed portions of the cap plate portion 20 in superior adjacency to the beverage-letting aperture 3 for selectively covering the beverage-letting aperture 3 with portions of the cap plate portion 20. The beverage can cap 100 may further optionally comprise a stopper feature as at 24.

The optional stopper feature 24 extends downwardly relative to the cap plate portion 20 for engaging a select portion of the aperture edge 1 of the beverage-letting aperture 3 for providing cap-to-can rotative stop structure. In other words, the optional stopper feature 24 operates to prevent rotation of the cap 100 relative to the beverage can 120 by engaging the aperture edge 1 thereby structurally signifying the cap-closed configuration whereby portions of the cap plate portion 20 cover the beverage-letting aperture 3 for preventing contaminants from entering the can body 10 via the beverage-letting aperture 3.

Figure 1:
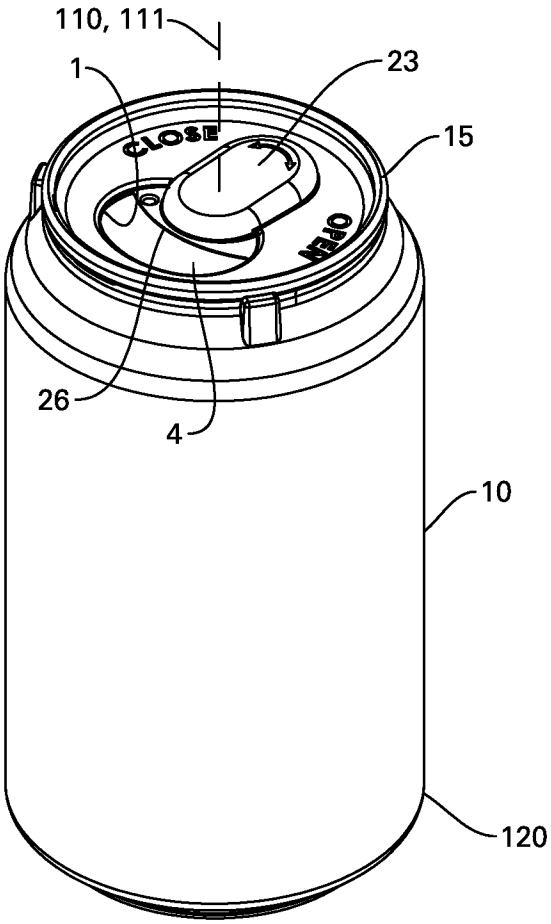
FIG. 1 is a top perspective view of a generic beverage can outfitted with a first beverage can cap according to the present invention showing the first beverage can cap in a rotatably open position relative to the generic beverage can.
Figure 4:
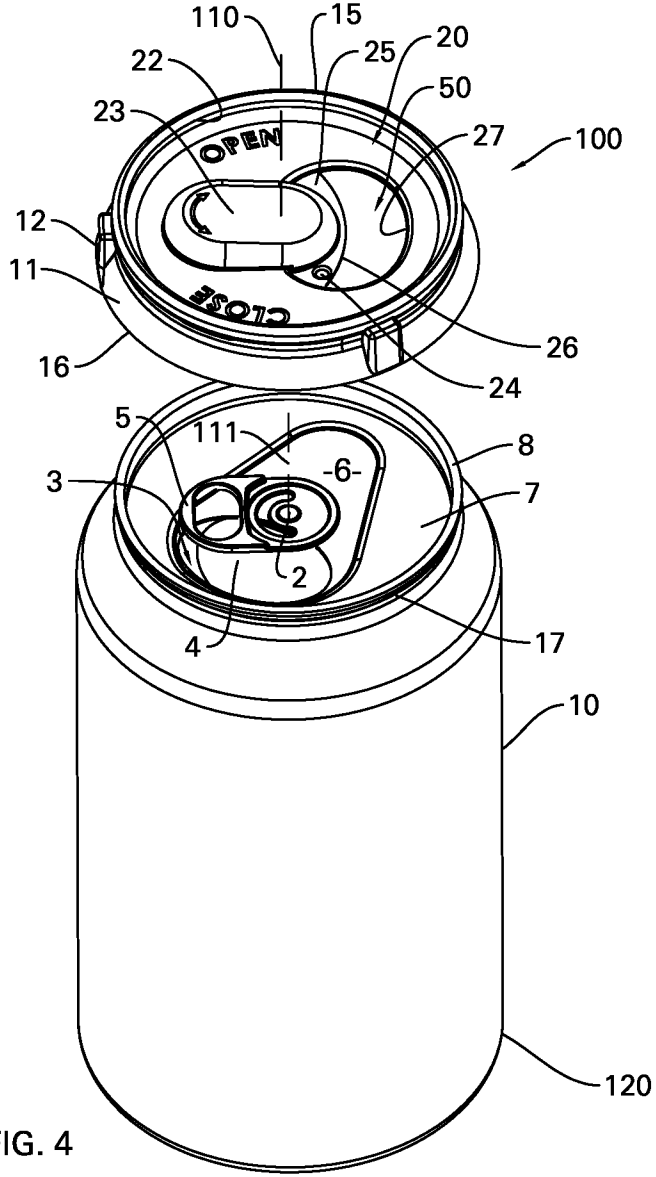
FIG. 4 is an exploded top perspective view of a generic beverage can and the first beverage can cap according to the present invention showing the first beverage can cap exploded from the beverage can in a rotatably closed position relative to the generic beverage can.
Figure 3:
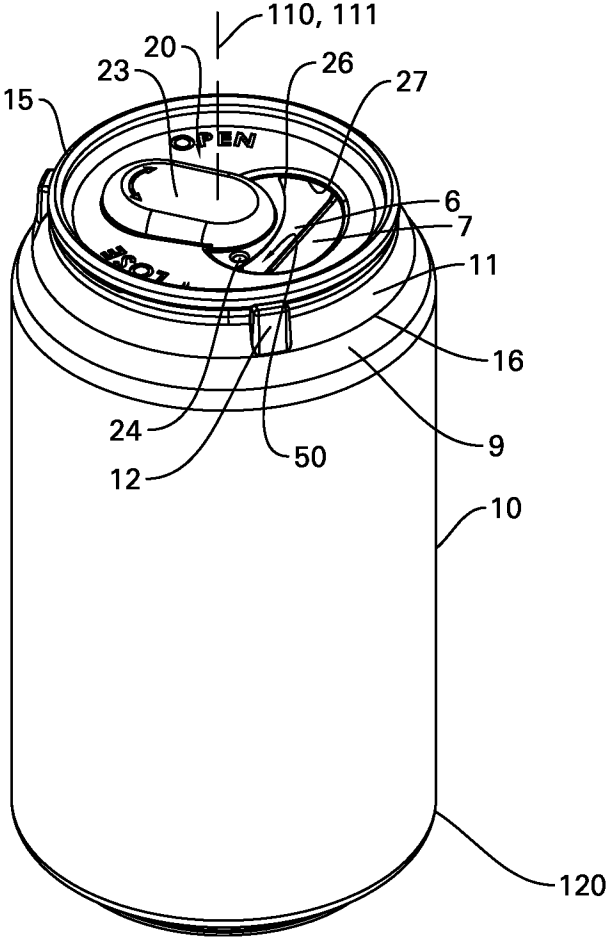
FIG. 3 is a top perspective view of a generic beverage can outfitted with the first beverage can cap according to the present invention showing the first beverage can cap in a rotatably closed position relative to the generic beverage can.
Figure 6:
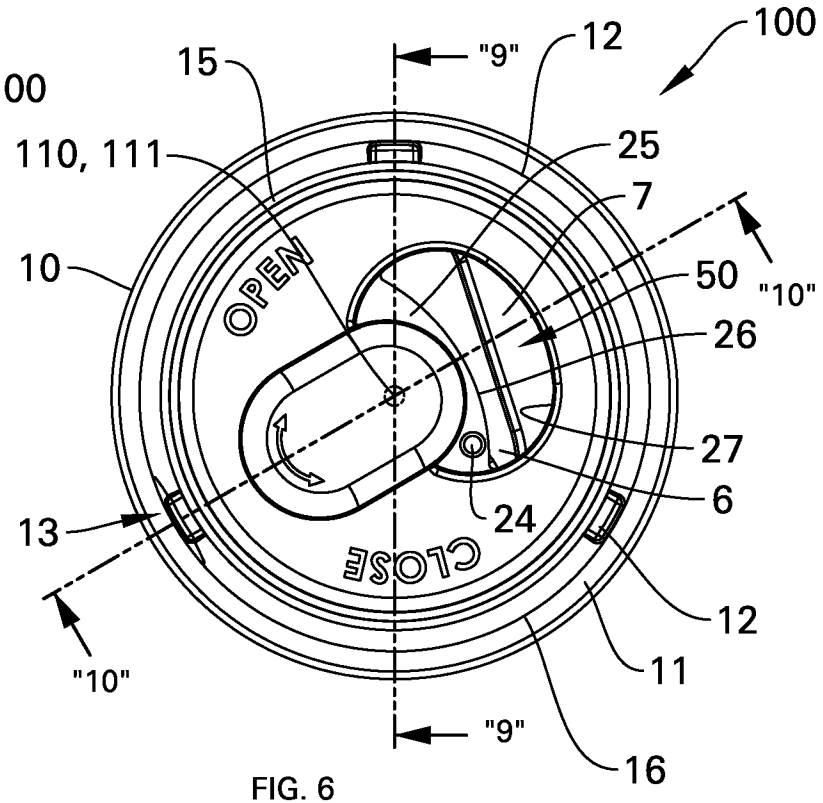
FIG. 6 is a top plan view of the first beverage can cap according to the present invention as outfitted upon a generic beverage can showing the first beverage can cap in a rotatably closed position relative to the generic beverage can.
Figure 5:
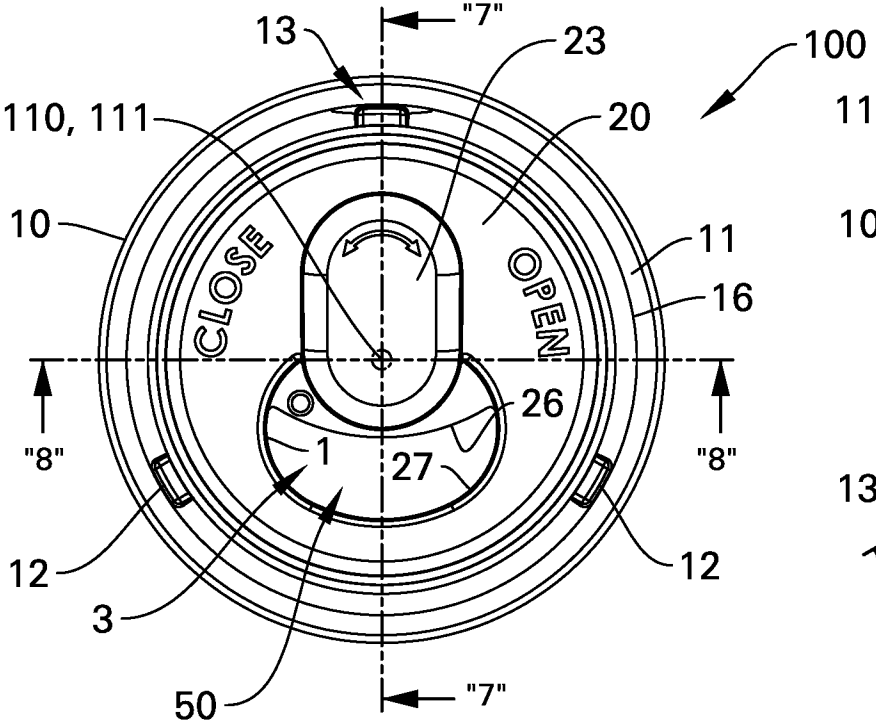
FIG. 5 is a top plan view of the first beverage can cap according to the present invention as outfitted upon a generic beverage can showing the first beverage can cap in a rotatably open position relative to the generic beverage can.
Figure 8:
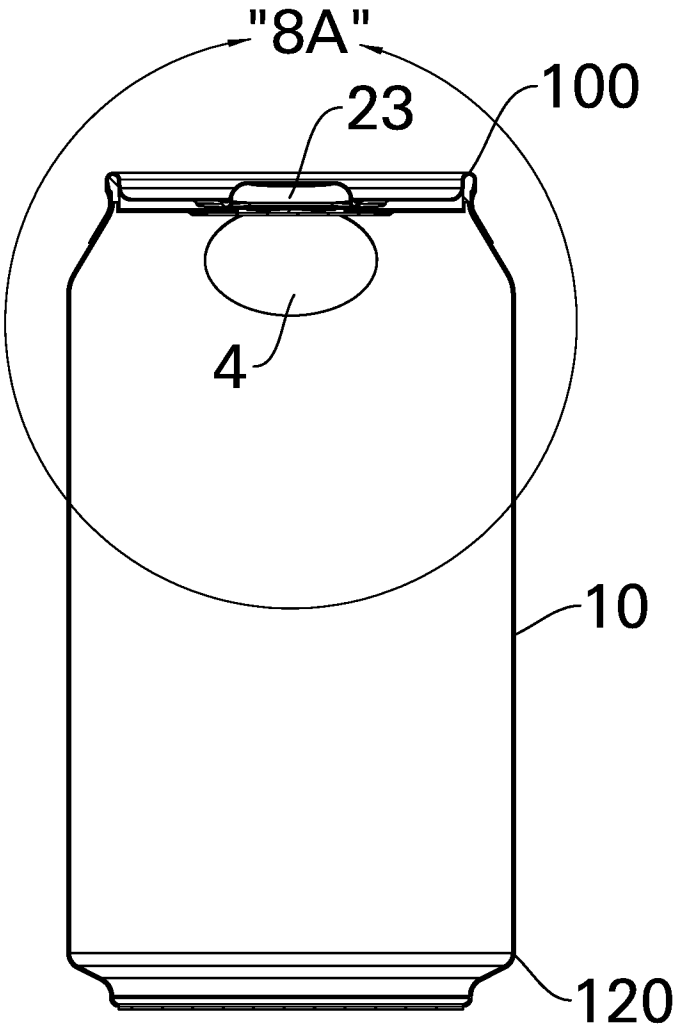
FIG. 8 is a frontal longitudinal cross-sectional view of the first beverage can cap according to the present invention as outfitted upon a generic beverage can as sectioned from FIG. 5 to depict structures of the first beverage can cap in the rotatably open position relative to the generic beverage can.
Figure 7:
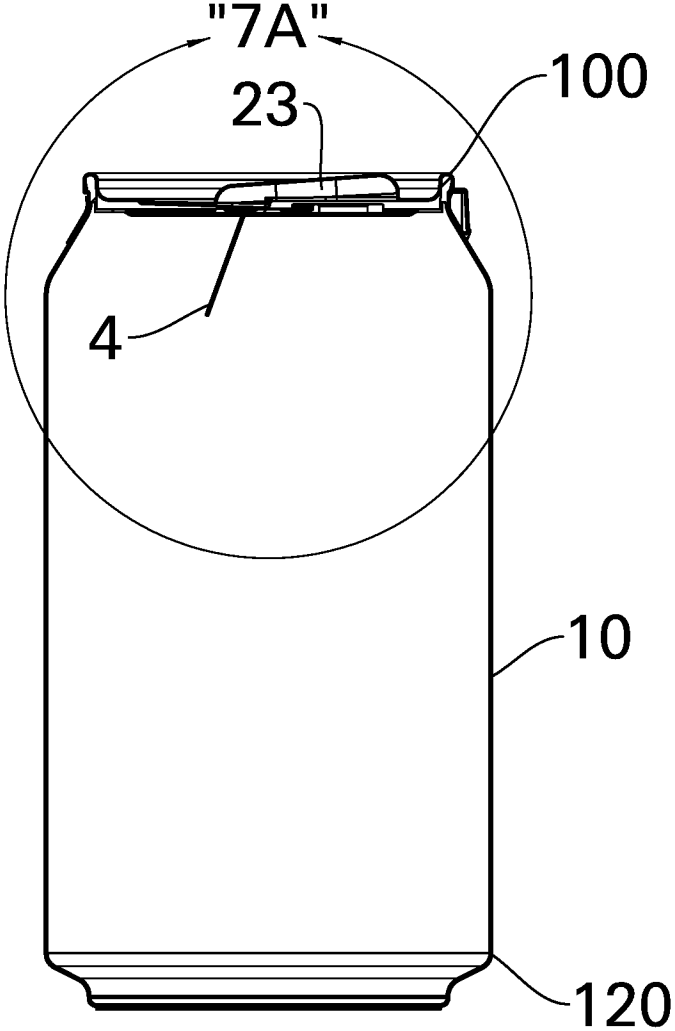
FIG. 7 is a medial longitudinal cross-sectional view of the first beverage can cap according to the present invention as outfitted upon a generic beverage can as sectioned from FIG. 5 to depict structures of the first beverage can cap in the rotatably open position relative to the generic beverage can.
Figure 7A:
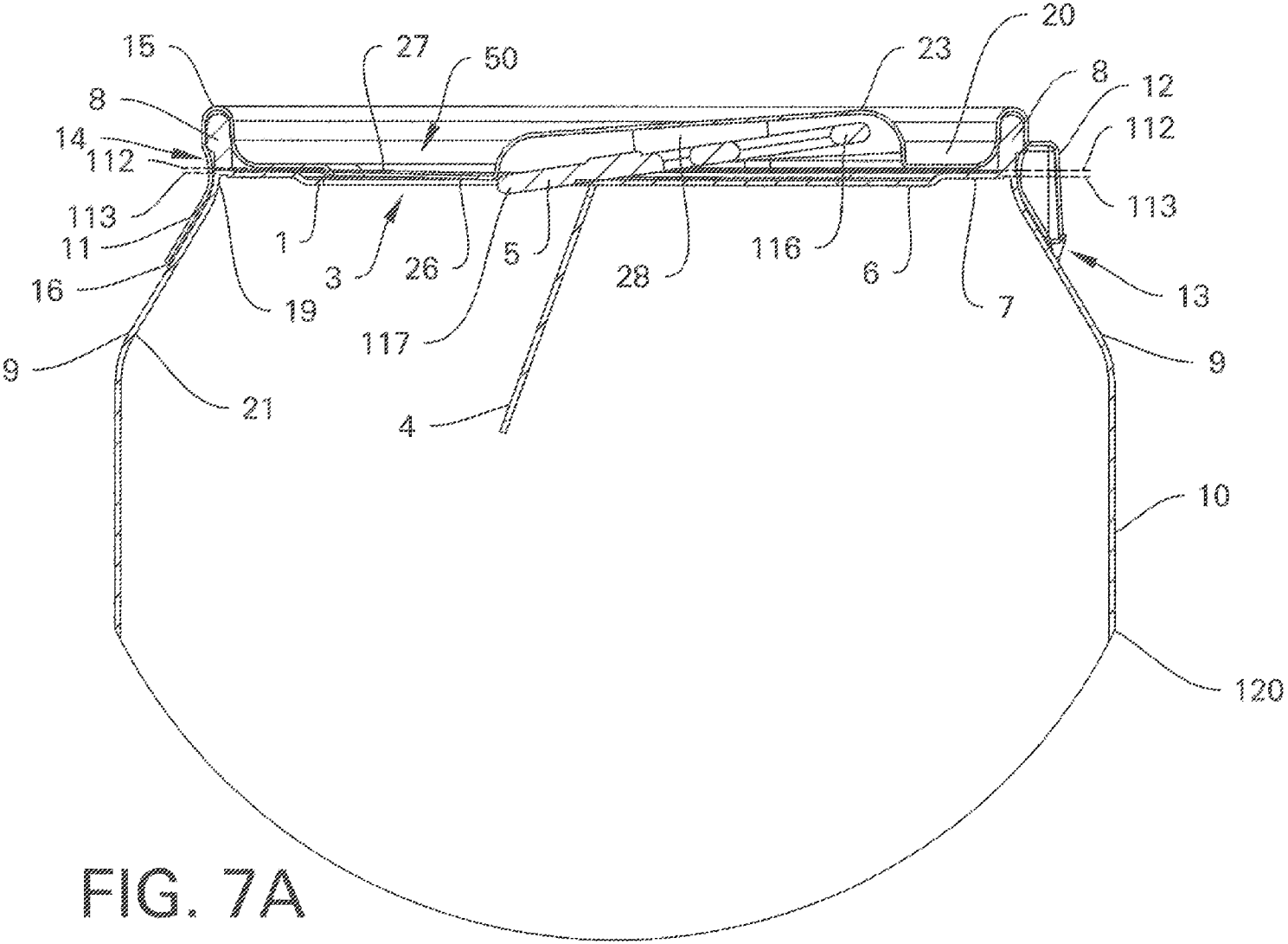
FIG. 7A is an enlarged fragmentary sectional view as enlarged and sectioned form FIG. 7 to depict in greater structural detail the first beverage can cap according to the present invention as outfitted upon a generic beverage can.
Figure 8A:
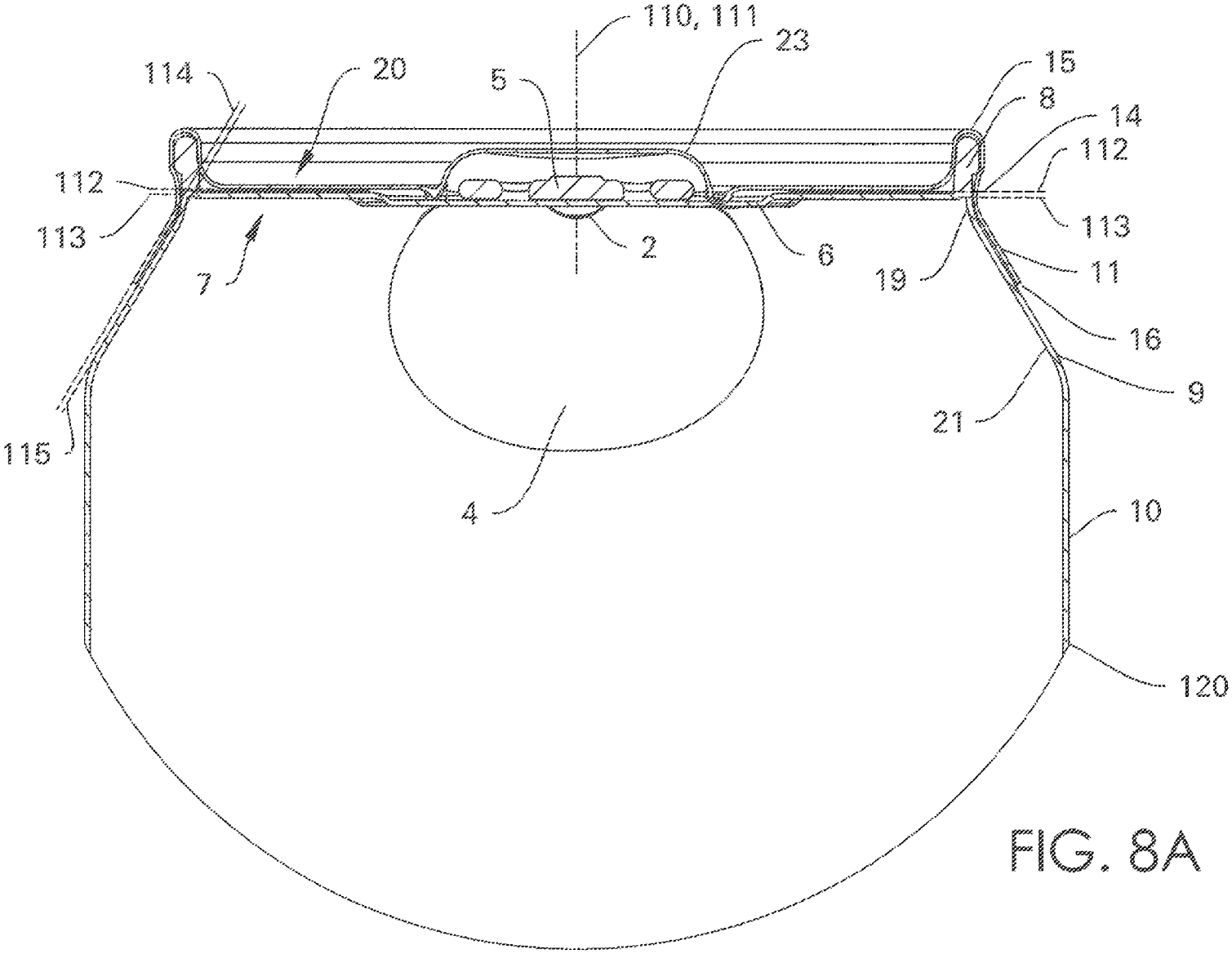
FIG. 8A is an enlarged fragmentary sectional view as enlarged and sectioned form FIG. 8 to depict in greater structural detail the first beverage can cap according to the present invention as outfitted upon a generic beverage can.
Figure 10:
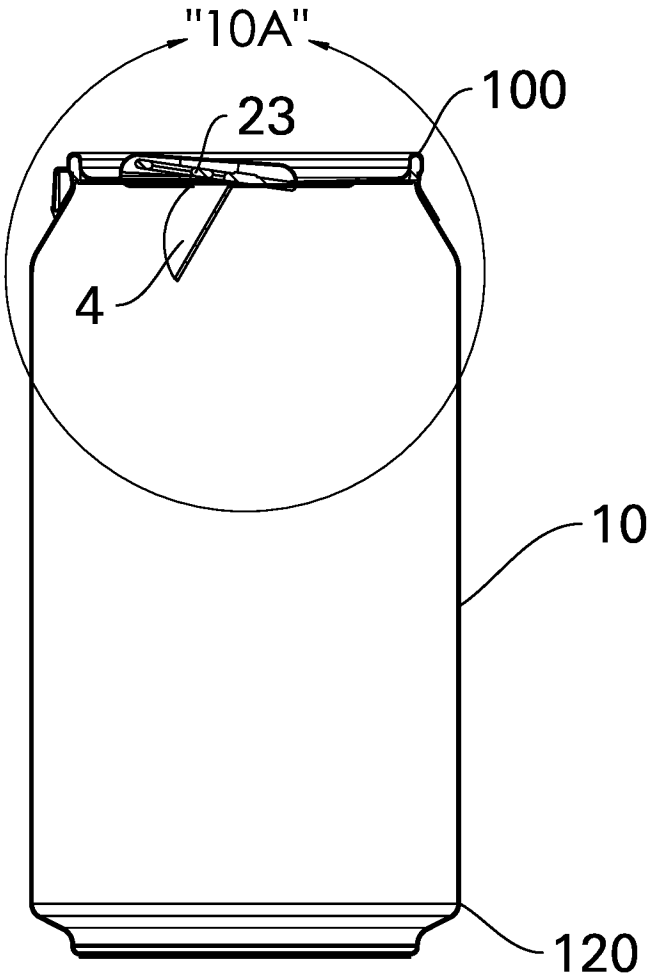
FIG. 10 is an oblique longitudinal cross-sectional view of the first beverage can cap according to the present invention as outfitted upon a generic beverage can as sectioned from FIG. 6 to depict structures of the first beverage can cap in the rotatably closed position relative to the generic beverage can.
Figure 9:
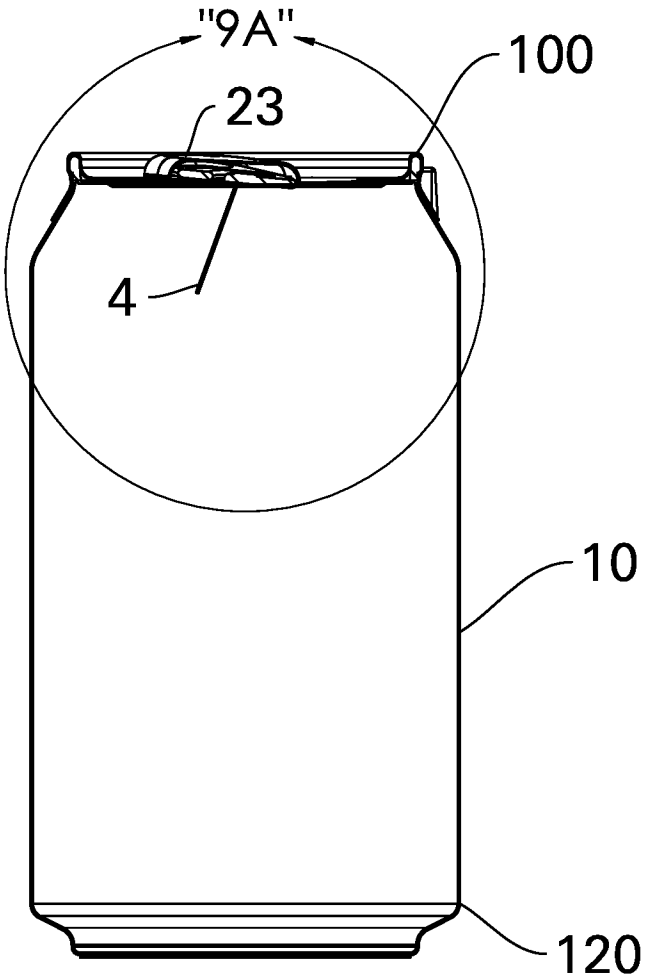
FIG. 9 is a medial longitudinal cross-sectional view of the first beverage can cap according to the present invention as outfitted upon a generic beverage can as sectioned from FIG. 6 to depict structures of the first beverage can cap in the rotatably closed position relative to the generic beverage can.
Figure 9A:
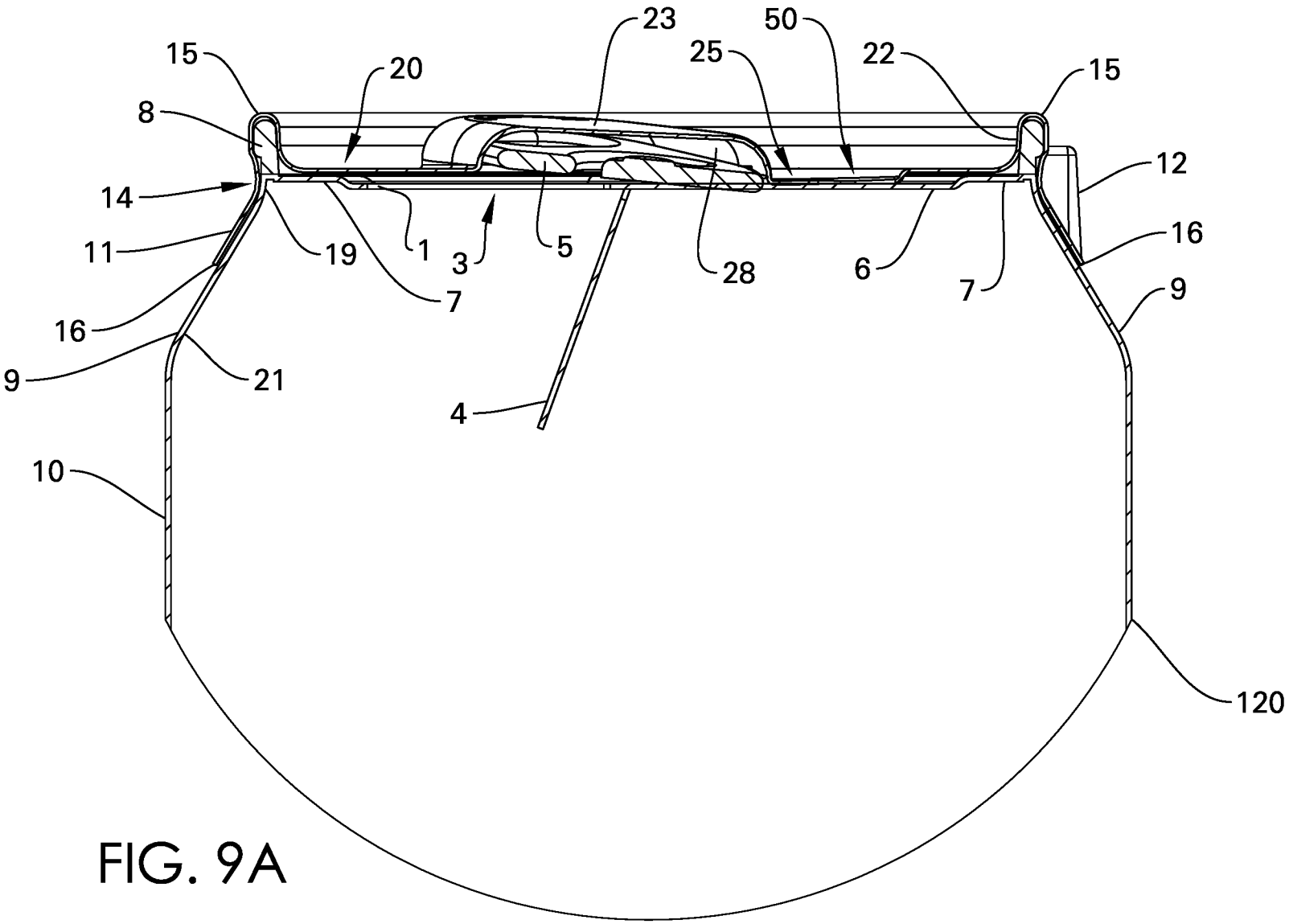
FIG. 9A is an enlarged fragmentary sectional view as enlarged and sectioned form FIG. 9 to depict in greater structural detail the first beverage can cap according to the present invention as outfitted upon a generic beverage can.
Figure 10A:
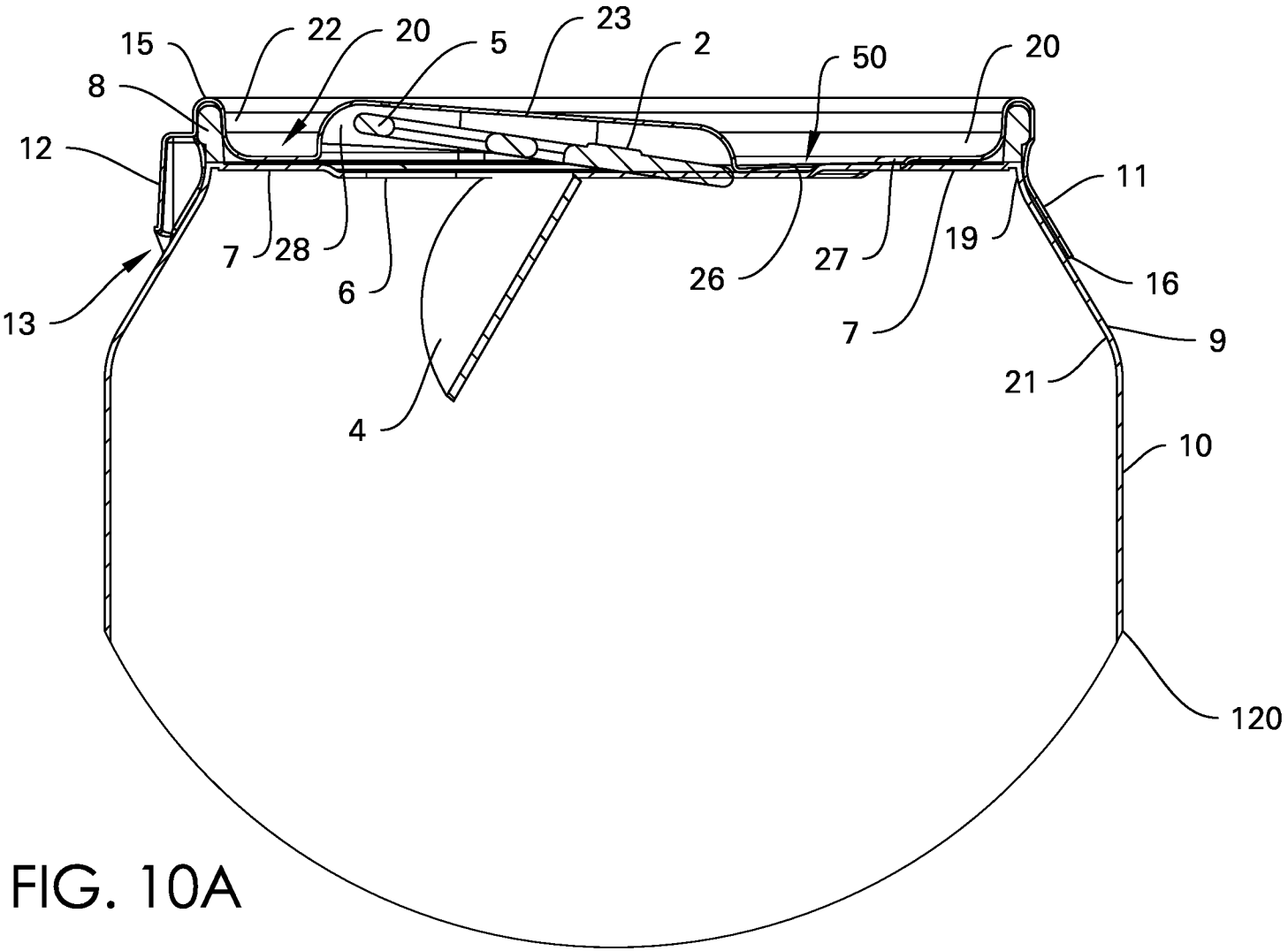
FIG. 10A is an enlarged fragmentary sectional view as enlarged and sectioned form FIG. 10 to depict in greater structural detail the first beverage can cap according to the present invention as outfitted upon a generic beverage can.
Figure 11:
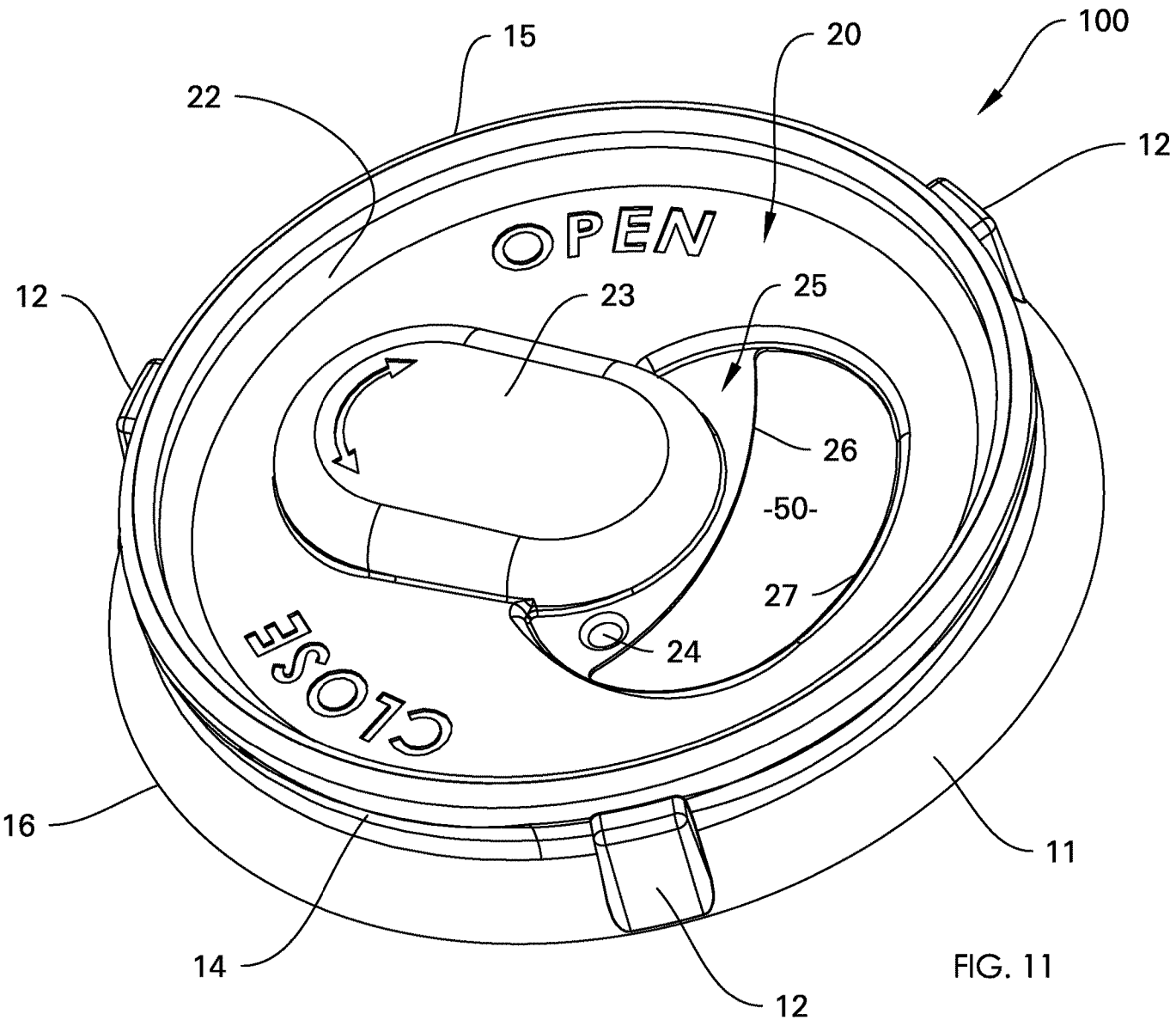
FIG. 11 is a first top perspective view of the first beverage can cap according to the present invention.
Figure 11A:
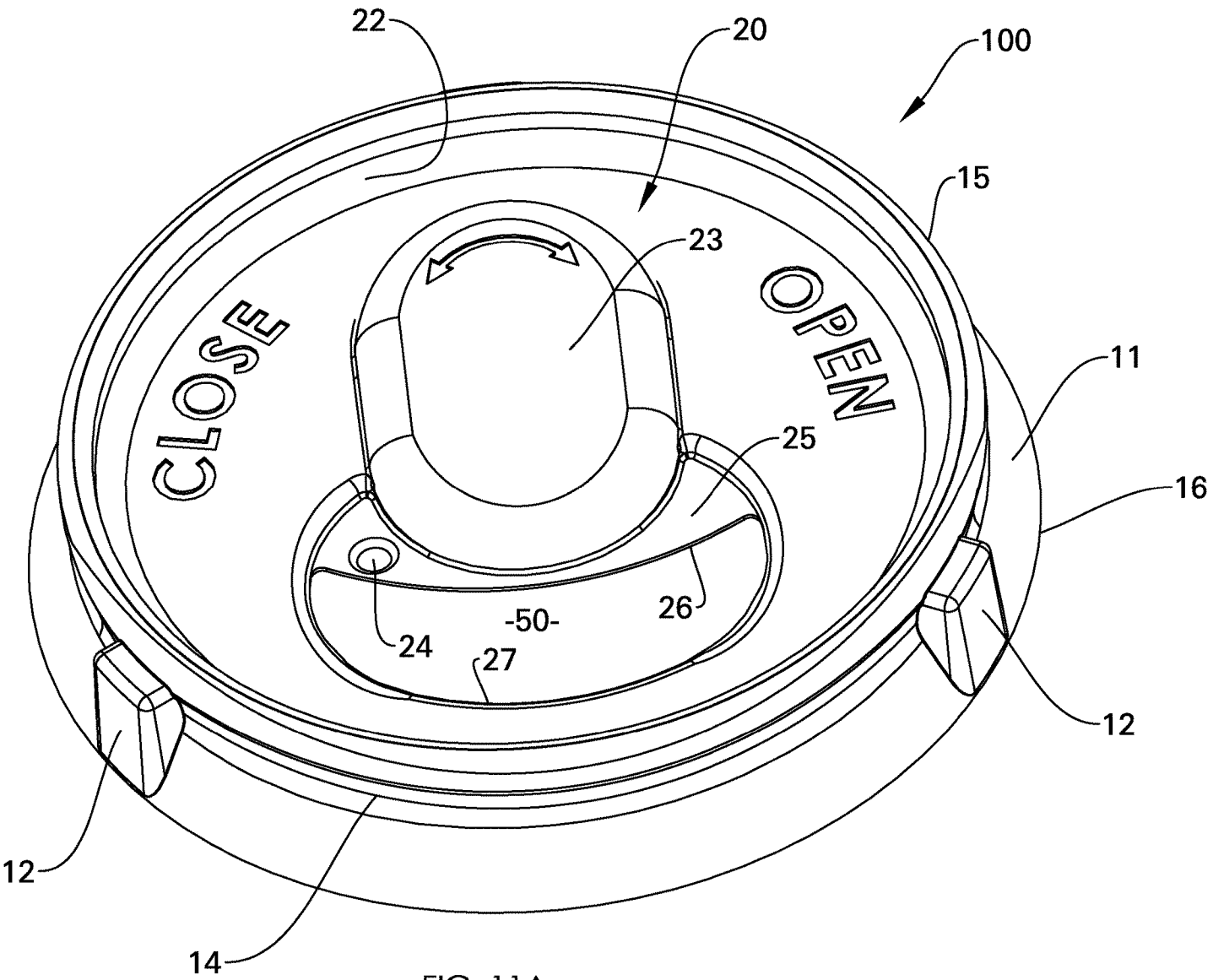
FIG. 11A is a second, anterior top perspective view of the first beverage can cap according to the present invention.
Figure 11B:
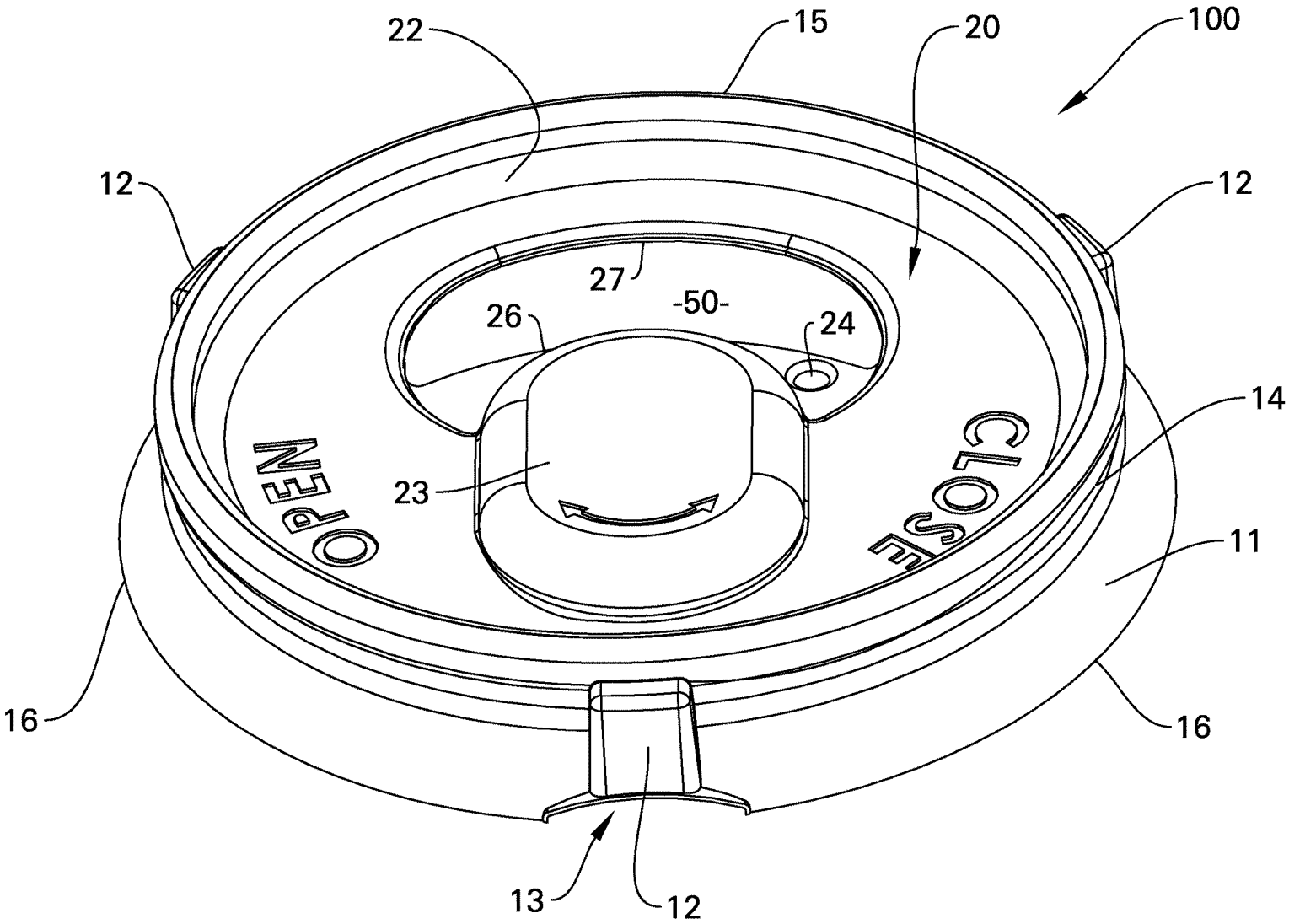
FIG. 11B is a third, posterior top perspective view of the first beverage can cap according to the present invention.
Figure 13:
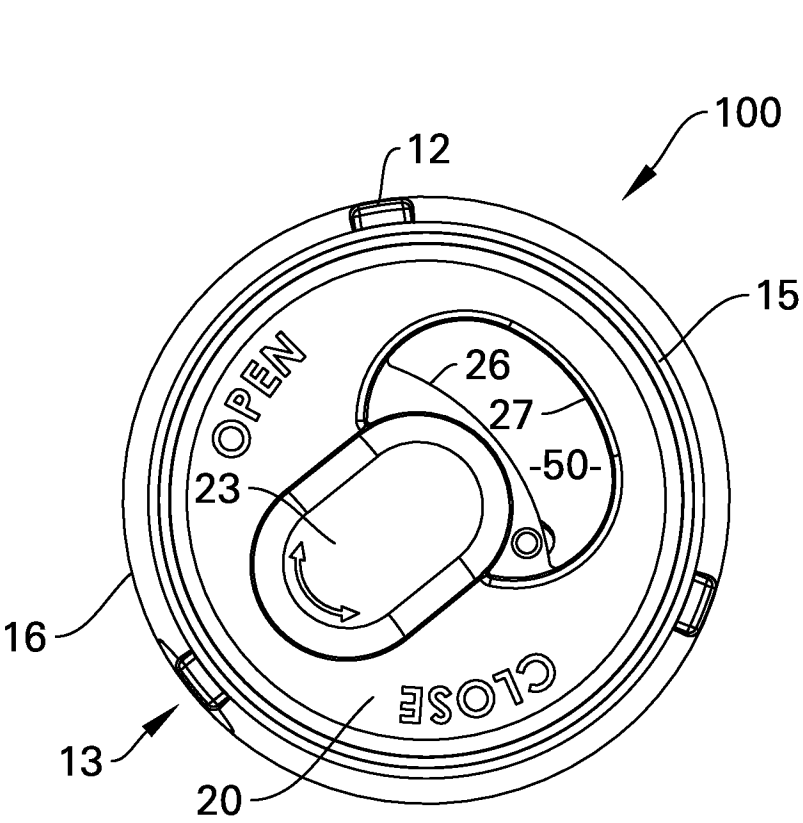
FIG. 13 is a second top plan view of the first beverage can cap according to the present invention showing the first beverage can cap in a second (closed) rotatable position as shown in side-by-side relation relative to the imagery shown in FIG. 12 for ease of comparison.
Figure 12:
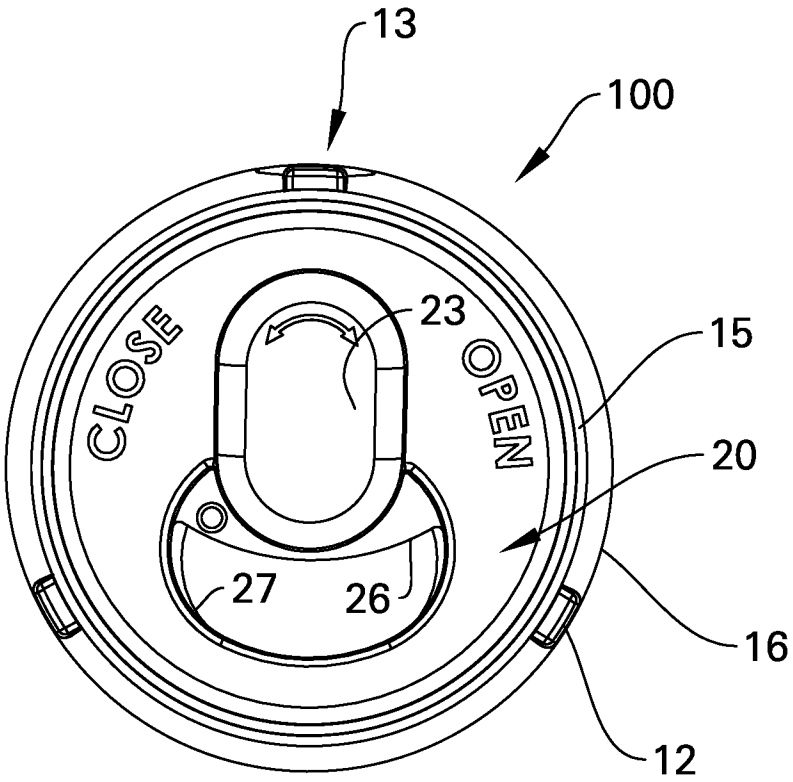
FIG. 12 is a first top plan view of the first beverage can cap according to the present invention showing the first beverage can cap in a first (open) rotatable position and shown in side-by-side relation relative to the imagery shown in FIG. 13 for ease of comparison.
Figure 15:
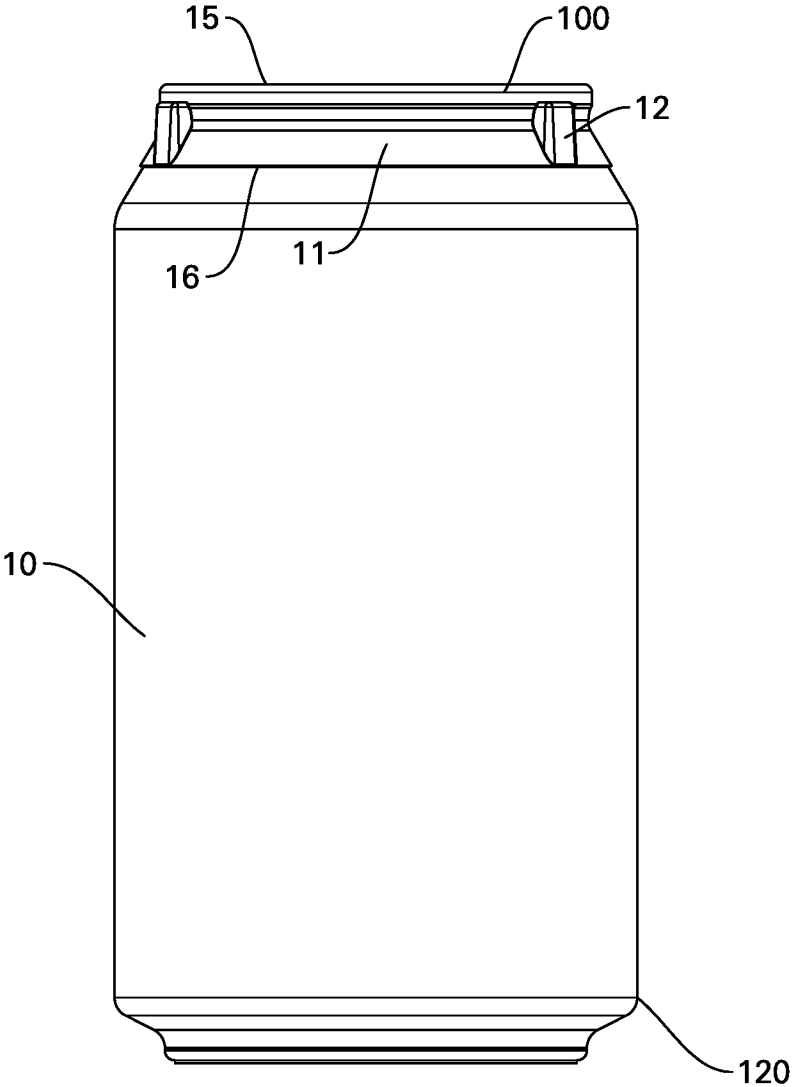
FIG. 15 is an anterior elevational view of a generic beverage can outfitted with the first beverage can cap according to the present invention.
Figure 14:
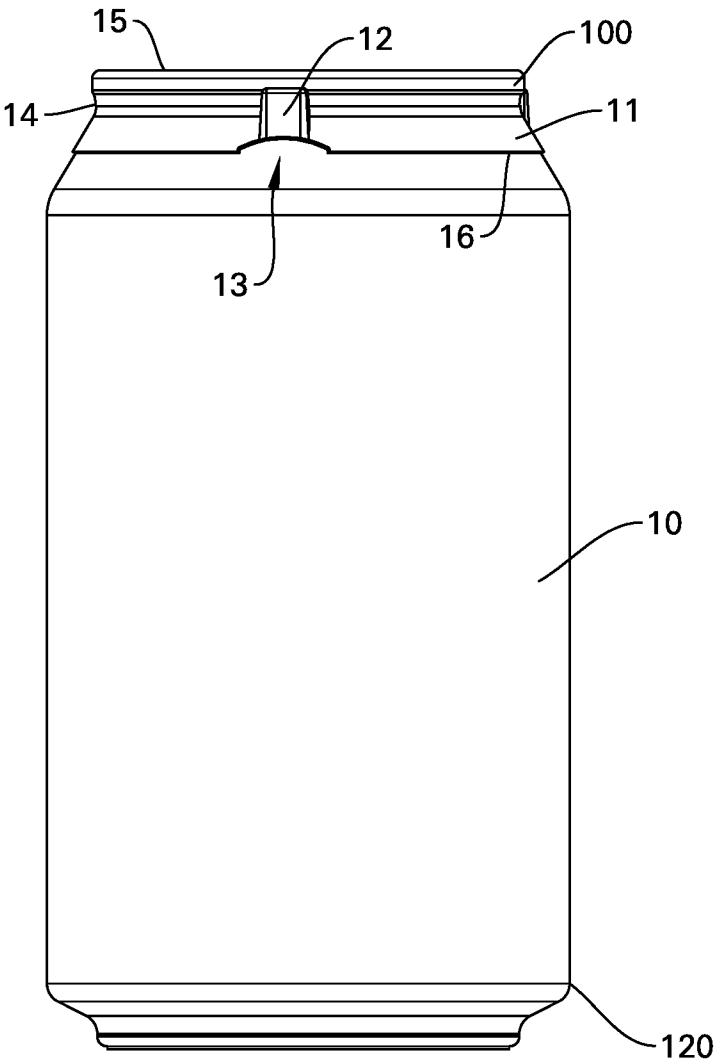
FIG. 14 is a posterior elevational view of a generic beverage can outfitted with the first beverage can cap according to the present invention.
Figure 17:
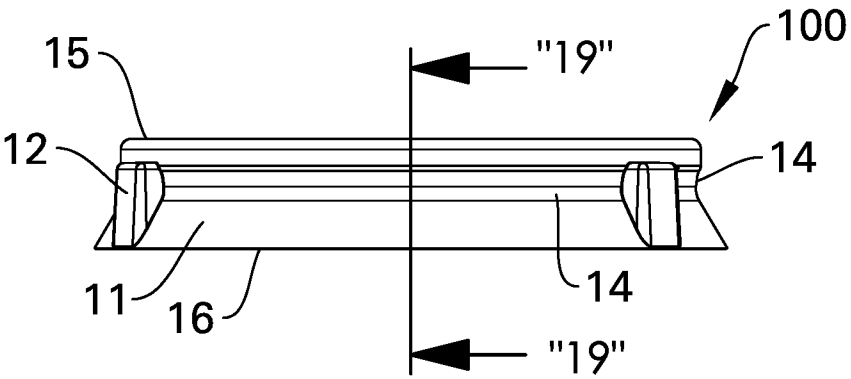
FIG. 17 is an anterior edge view of the first beverage can cap according to the present invention.
Figure 16:
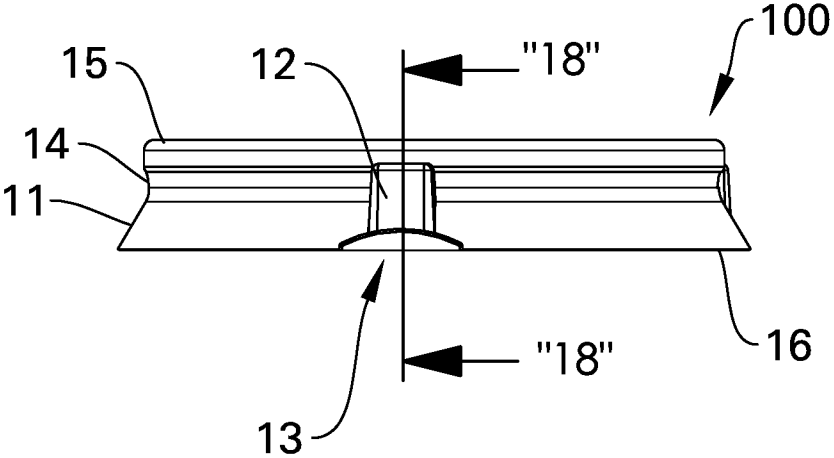
FIG. 16 is a posterior edge view of the first beverage can cap according to the present invention.
Figure 18:
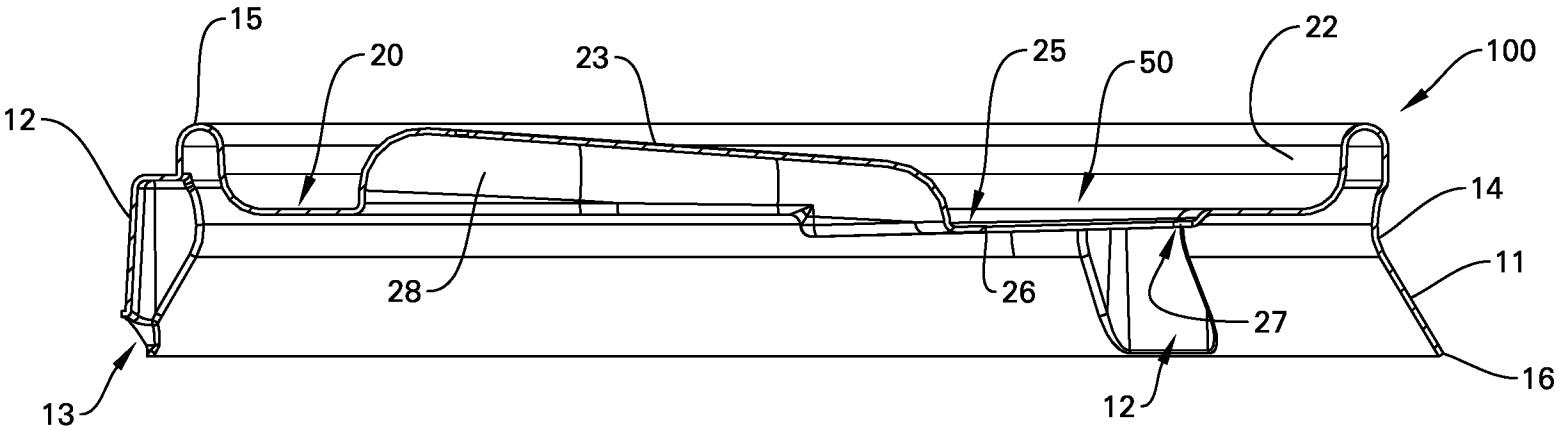
FIG. 18 is an enlarged, longitudinal sectional view of the first beverage can cap according to the present invention as enlarged and sectioned from FIG. 16 to show in greater detail structures associated with the first beverage can cap.
Figure 19:
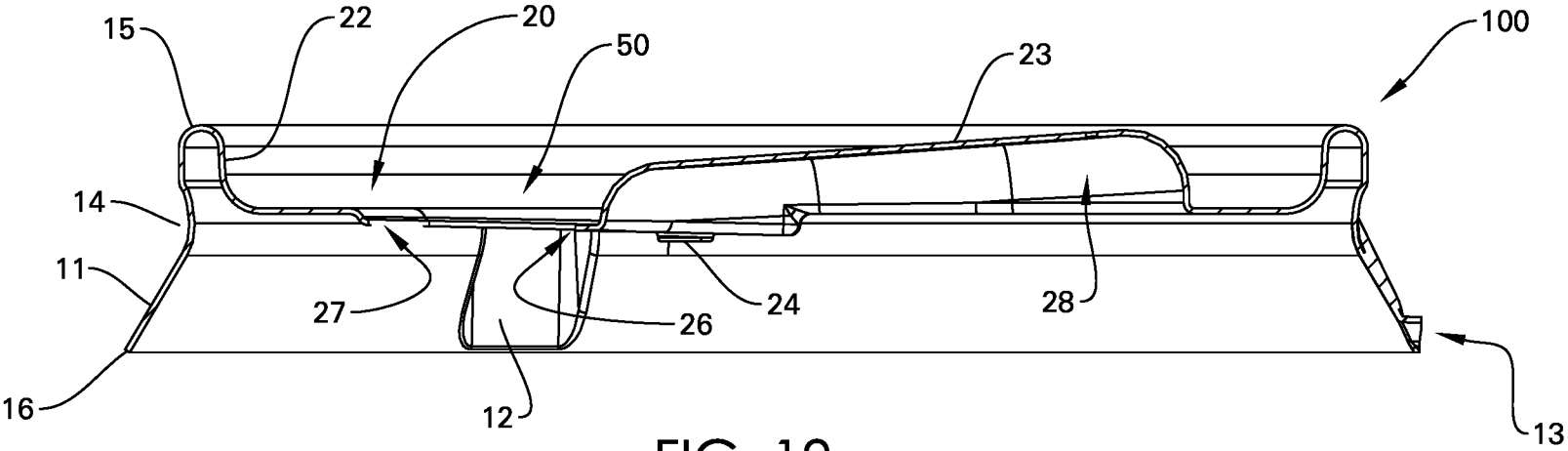
FIG. 19 is an enlarged, longitudinal sectional view of the first beverage can cap according to the present invention as enlarged and sectioned from FIG. 17 to show in greater detail structures associated with the first beverage can cap.
Figure 20:
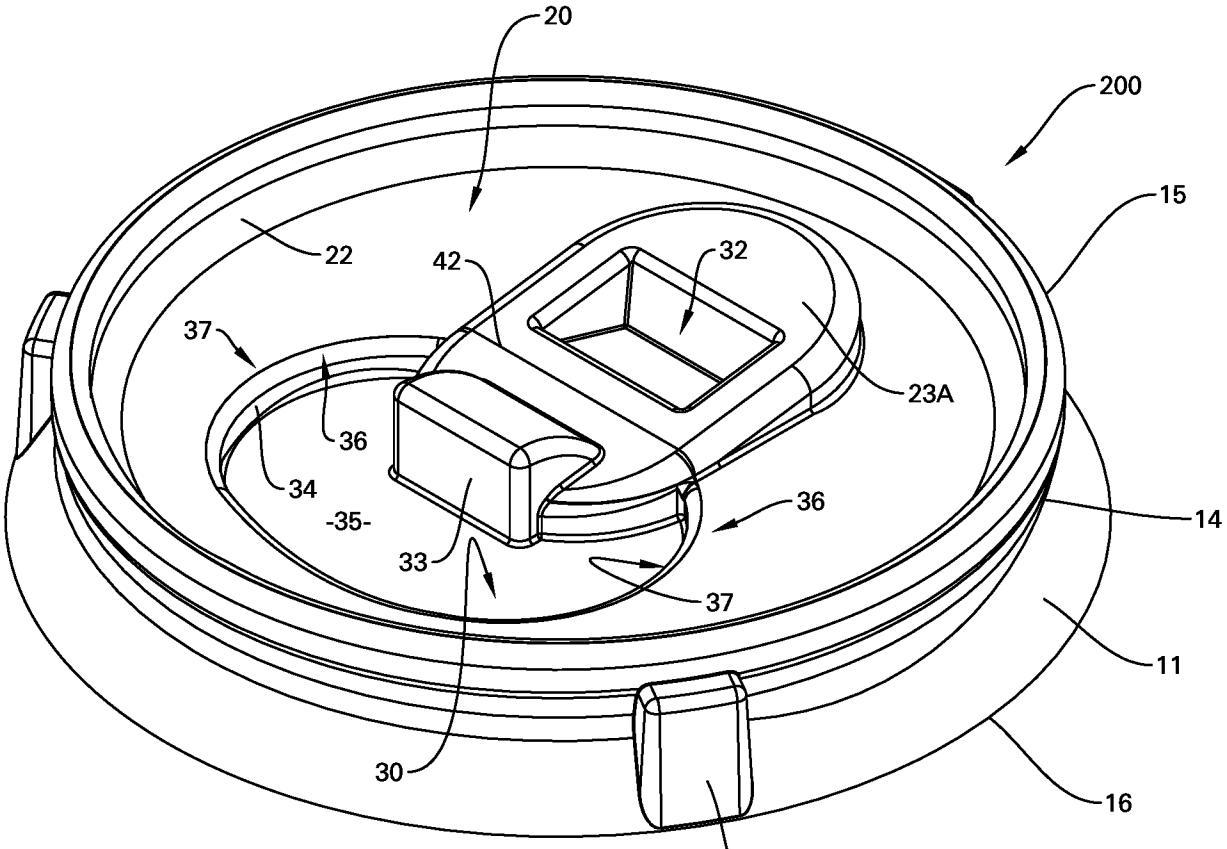
FIG. 20 is a first anterior top perspective view of a second beverage can cap according to the present invention showing the second beverage can cap in a cap-closed configuration.

Summarizing the functionality of beverage can cap 100, it will be recalled that to open the beverage can 120, the user directs manual force into the can-opening tab element 5 snapping and pushing down the scored plate portion 4 thereby creating or forming beverage-letting aperture 3 at which point beverage 102, otherwise contained in the can body 10, is ready to be consumed. The beverage can cap 100 may then be snapped on top of the pre-opened beverage can 120 in the cap-open position as generally depicted in FIGS. 1 and 2. The can-opening tab element 5 fits into or is received by the can opener-receiving or tab-receiving protrusion 23 within a can opener-receiving or tab-receiving space as depicted and referenced at 28. The beverage can cap 100 is depicted in the cap-open position or configuration relative to the beverage-letting aperture 3 in FIGS. 1, 2, 5, 7, 8, 7A, and 8A.

In the cap-open position or configuration, the cap opening 50 aligns with the beverage-letting aperture 3. As comparatively referenced in FIGS. 2 and 7A, the can-opening tab element 5 fits into the can opener-receiving or tab-receiving space 28. The cap rim 15 fits on top of the upper can rim 8 and the cap groove 14 resiliently snaps into or in exterior adjacency to the can groove 17 thereby holding the beverage can cap 100 on top of the beverage can 120, but is still rotatable about the cap axis of rotation 110 as required to open or close the beverage can cap 100 relative to the beverage-letting aperture 3.

A side wall 22 of the beverage can cap 100 extends in radial outer adjacency to the cap plate portion 20 and slides along the inner wall 18 of the upper can rim 8. The lower cap skirt 11 embraces the frustoconical can neck portion 9 of the beverage can 120. The frustoconical can neck portion 9 comprises an upper neck portion as at 19 and a lower neck portion as at 21. The lower skirt edge 16 preferably terminates intermediate the upper and lower neck portions 19 and 20 for enhancing safe use of the beverage can cap 100 during cap rotation. In other words, the lower skirt edge 16 of the lower cap skirt 11 preferably terminates intermediate the length of the can neck portion 9 for preventing the lower skirt edge 16 from making direct contact with a user's hand or fingers when rotating the beverage can cap 100 relative to the beverage can 120 for improving the safety of the beverage can cap 100.

The reader will note that the lower cap skirt 11 may be optionally provided in shorter lengths and may even be made a length on par with the relatively shorter lower cap skirt length otherwise depicted in connection with beverage can cap 300. The lower cap skirt 11 of the beverage can caps 100 and 200, as optionally shortened, may still be outfitted with cap-turning nubs 12 and manufactured without sharp edging. Removal of unnecessary material is cost effective and allows for better "stackability" and eases manufacturing, specifically in connection with die cutting processes.

The optional stopper feature 24 prevents the beverage can cap 100 from rotating past preferred stop points for structurally signifying full-open and full-closed cap positions or configurations. The cap-open position or configuration is depicted in FIGS. 1, 2, 5, 7, 8, 7A, and 8A, and the cap-closed position or configuration is depicted in FIGS. 3, 4, 6, 9, 10, 9A, and 10A. In either case, the optional stopper feature 24 prevents rotation of the beverage can cap 100 past aperture edging 1 of the beverage-letting aperture 3, and is preferably formed in a recessed portion 25 of the cap plate portion 20 for maximizing its downward extension for engaging aperture edging 1 of the beverage-letting aperture 3.

The recessed portion 25 of the cap plate portion 20 terminates at the cap aperture 50 defined radially inwardly relative to the cap axis of rotation 110 by an inner edge portion 26 and defined radially outwardly relative to the cap axis of rotation 110 by an outer edge portion 27. The cap-turning nubs 12 help the user better grip the beverage can cap 100 when rotating the beverage can cap 100 relative to the beverage can 120 by circularly turning it to either the cap-closed or cap-open positions. The flange-like grip formation 13 helps the user remove the beverage can cap 100 from the beverage can 120 by providing a flange-like structure for finger or fingernail engagement. In the preferred embodiment, the flange-like grip formation 13 is formed on the posterior portion of the beverage can cap 100 in alignment with a select turning nub 12.

The second alternative beverage can cap 200 according to the present invention preferably also comprises a lower cap skirt 11; an upper cap rim 15; an inwardly extending cap groove 14 intermediate the lower cap skirt 11 and the upper cap rim 15; and a cap plate portion 20 centrally located relative to the upper cap rim 15 generally extending in a cap plate plane 112. The second alternative beverage can cap 200 differs from the first alternative can cap 100 primarily by providing a relatively more complex or alternative tab element cover feature as at 23A along with a cap opening plug 30 pivotally attached to the alternative tab element cover feature 23A for selectively plugging a cap aperture or opening 50.

As earlier described, the lower cap skirt 11 of beverage can cap 200 preferably comprises an outer skirt edge 16; at least one, but preferably a series of circumferentially spaced cap-turning nubs as referenced at 12; and at least one flange-like grip formation as referenced at 13. It is contemplated that the flange-like grip formation 13 is preferably aligned with a select cap-turning nub 12, as exemplified by the posterior-most cap-turning nub 12. The cap-turning nubs 12 are designed to be manually operable by the user for rotating the beverage can cap 200 about the cap axis of rotation 110.

The second alternative beverage can cap 200 is removably and rotatably attachable to the upper can portion or lid portion of the beverage can 120, but in a manner in which rotation becomes less important as compared to the rotatability of beverage can cap 100. Whereas rotation as a primary function of beverage can cap 100, rotation is of secondary importance in connection with beverage can cap 200 given the presence of a cap plug 30 for covering/sealing the beverage-letting aperture 3 as discussed in more detail below.

Bearing the foregoing in mind, the second alternative beverage can cap 200 is removably and rotatably attachable to the upper can portion or lid portion of the beverage can 120 such that the cap rim 15 receives the upper can rim 8; the cap plate portion 20 extends in parallel relation to the can capping plate 7; the cap plug 30 and underlying cap opening 50 may be positioned in superior adjacency to or in alignment with the beverage-letting aperture 3 when in a cap-open configuration; and the inwardly extending cap groove 14 resiliently engages the can groove 17 via the inherent resiliency of the material construction for enhancing cap-to-can attachment.

The alternative raised tab element cover feature 23A extends upwardly from the cap plate portion 20 and is dimensioned for inferiorly or interiorly receiving the can-opening tab element 5 and superiorly or exteriorly providing the user with visual alignment aid for aligning the beverage can cap 200 relative to the can-opening tab element 5. The lower cap skirt 11 seats down upon the frustoconical can neck portion 9 such that the skirt plane 114 extends in parallel relation to the neck portion plane 115. The beverage can cap 200 is optionally rotatable about the can axis of rotation 110 for selectively positioning closed portions of the cap plate portion 20 in superior adjacency to the beverage-letting aperture 3 for selectively covering the beverage-letting aperture 3 with portions of the cap plate portion 20.

Figures 20A, 21A, 22A:
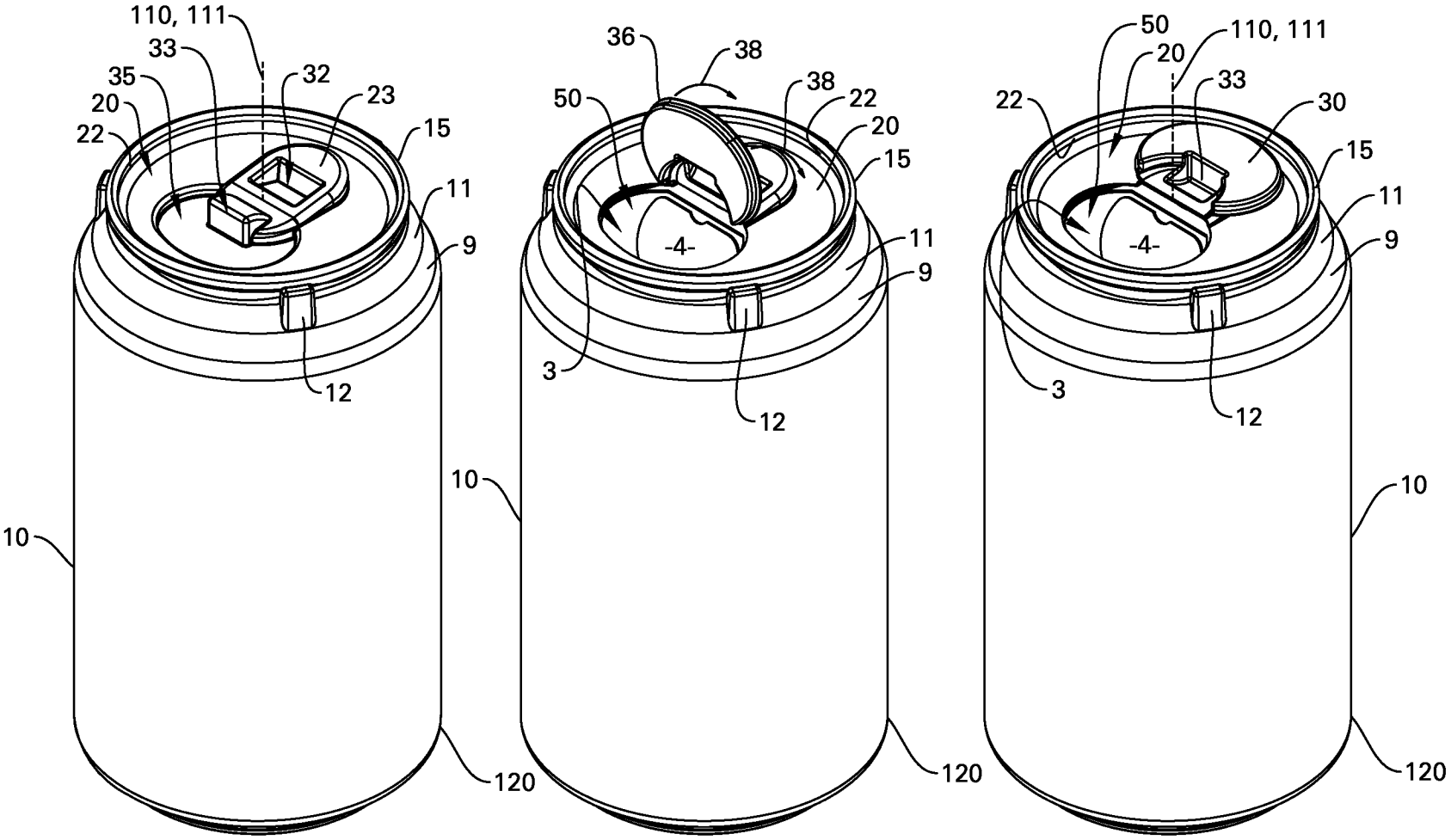
FIG. 20A is a first anterior top perspective view of a generic beverage can outfitted with the second beverage can cap according to the present invention showing the second beverage can cap in the cap-closed configuration.
FIG. 21A is a second top perspective view of a generic beverage can outfitted with the second beverage can cap according to the present invention showing the second beverage can cap in the first cap-open configuration.
FIG. 22A is a third top perspective view of a generic beverage can outfitted with the second beverage can cap according to the present invention showing the second beverage can cap in the second cap-open configuration.
Figure 21:
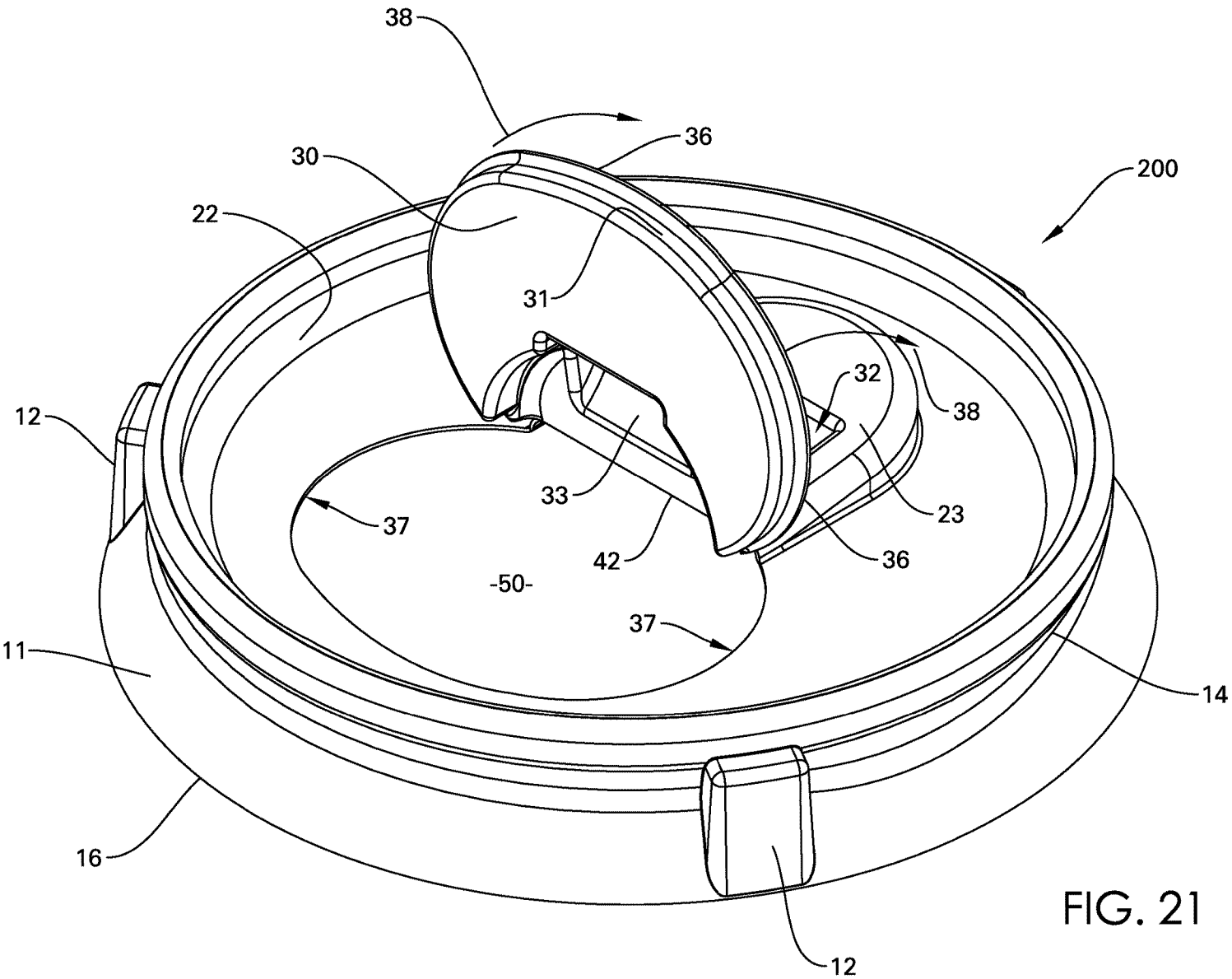
FIG. 21 is a second anterior top perspective view of the second beverage can cap according to the present invention showing the second beverage can cap in a first cap-open configuration.

As prefaced above, the beverage can cap 200 preferably comprises a cap plug as at 30. Unlike the first alternative beverage can cap 100, the second alternative beverage can cap 200 provides an additional plugging method for selectively closing and opening the beverage can 120. When the beverage can cap 200 is removably and rotatably attached to the upper can portion of the beverage can 120, the cap opening 50 may preferably be aligned with the beverage-letting aperture 3 as generally depicted in FIGS. 21A and 22A.

Figure 27:
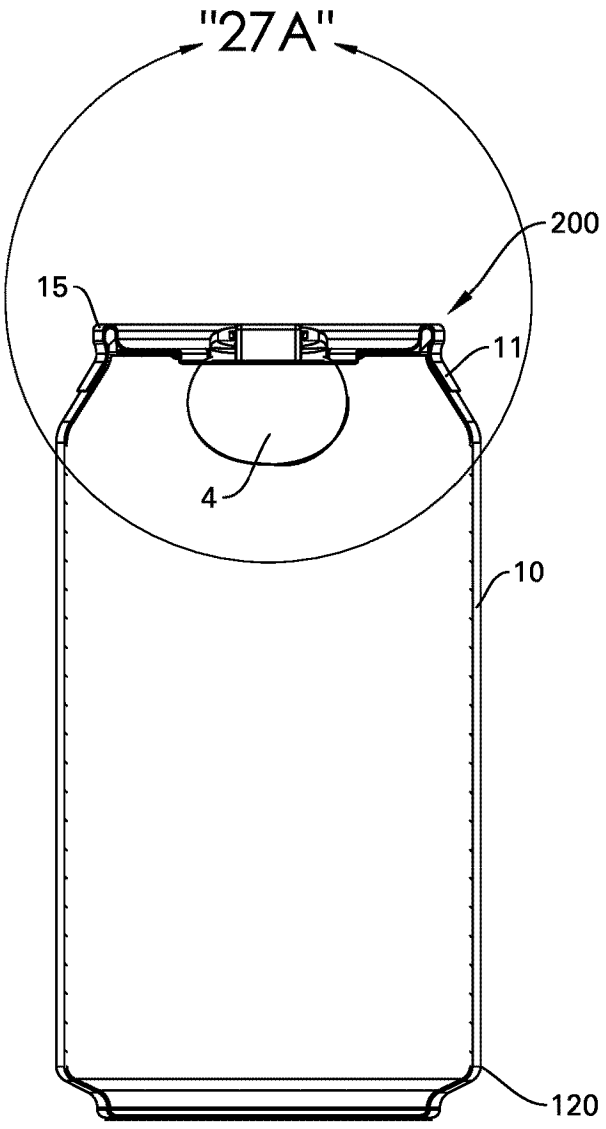
FIG. 27 is a para-frontal cross-sectional view as sectioned from FIG. 26 and shown in side-by-side relation to imagery shown in FIG. 26 for ease of comparison.
Figure 27A:
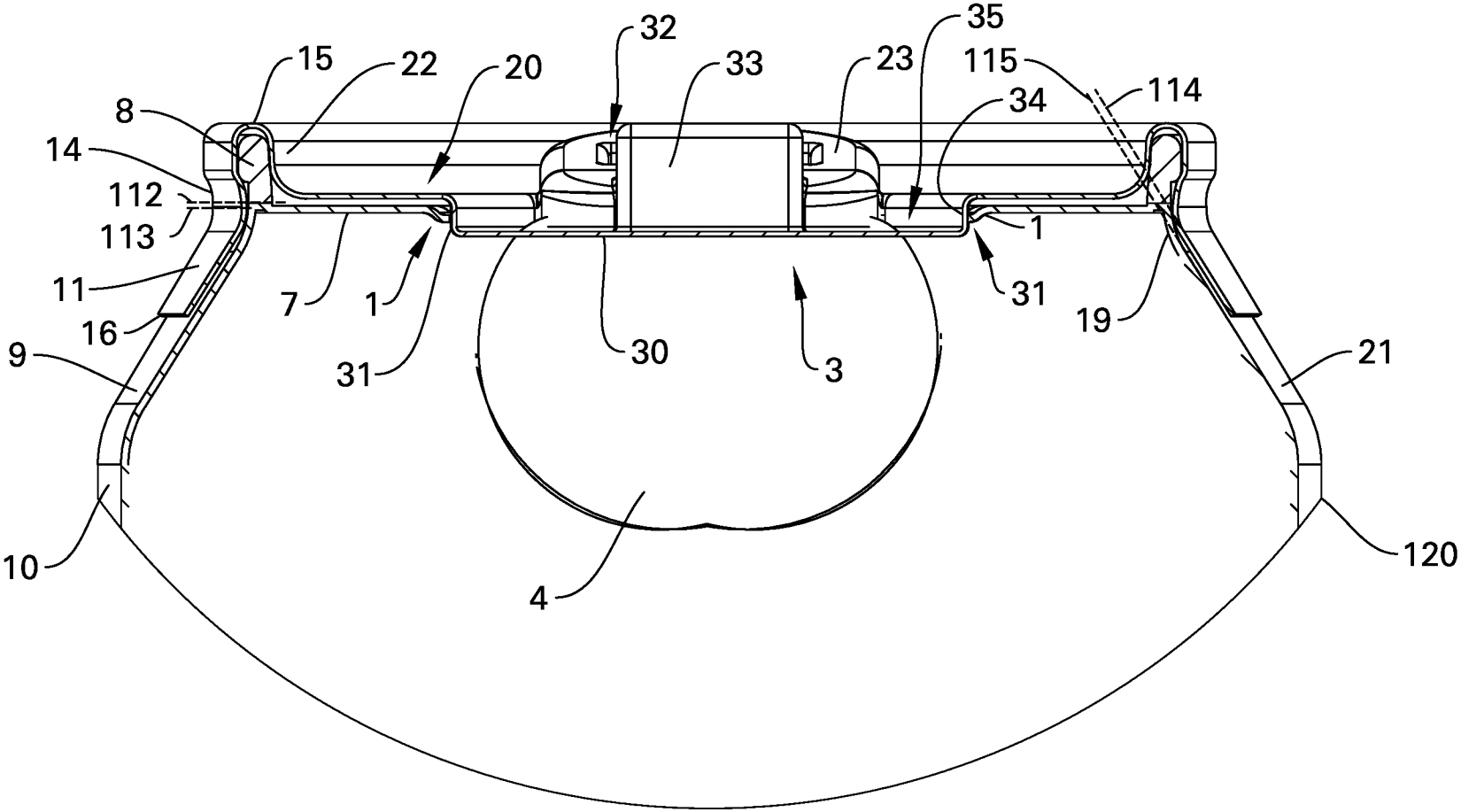
FIG. 27A is an enlarged fragmentary sectional view as enlarged and sectioned from FIG. 27 to show in greater detail the structures associated with the second beverage can cap as outfitted upon the generic beverage can.
Figure 28A:
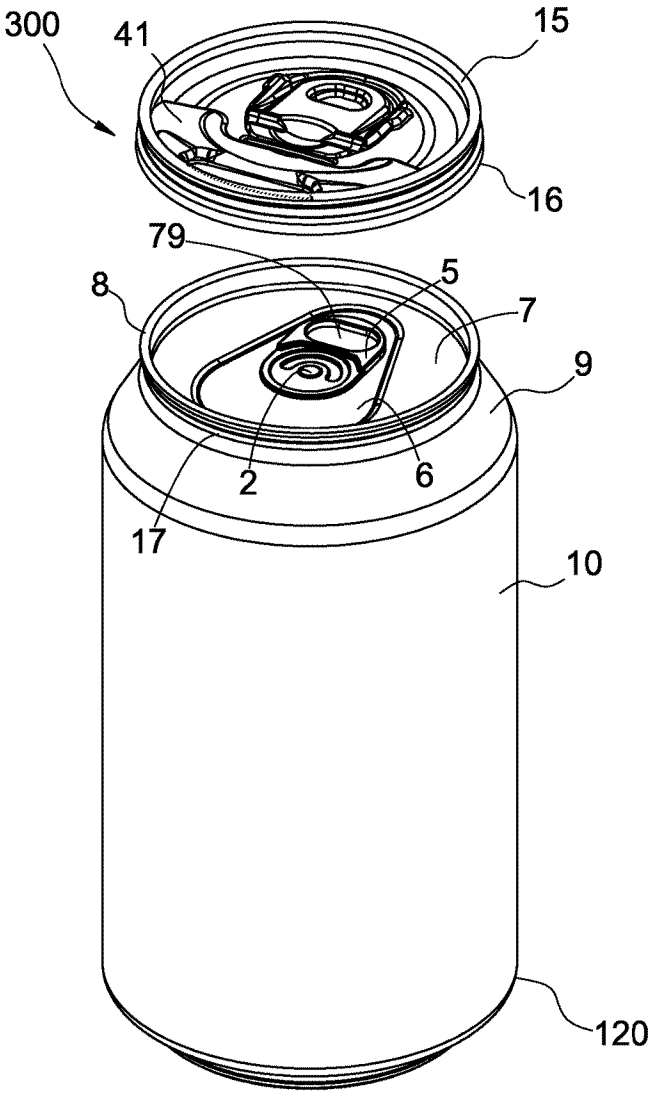
FIG. 28A is an exploded top perspective view of a generic beverage can and the third beverage can cap according to the present invention showing the third beverage can cap exploded from the generic beverage can.
Figure 28:
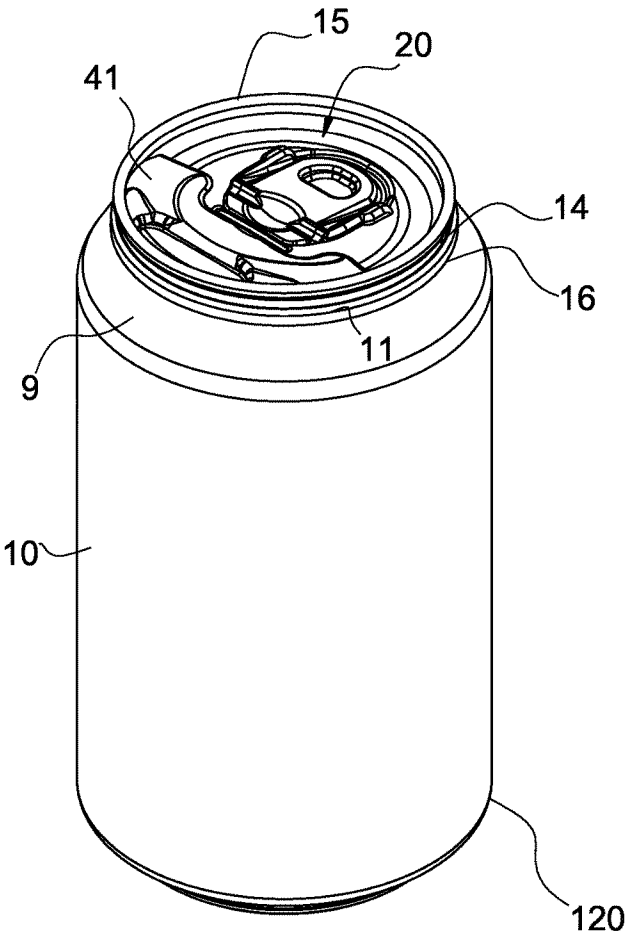
FIG. 28 is a first top perspective view of a generic beverage can outfitted with a third beverage can cap according to the present invention.
Figure 29:
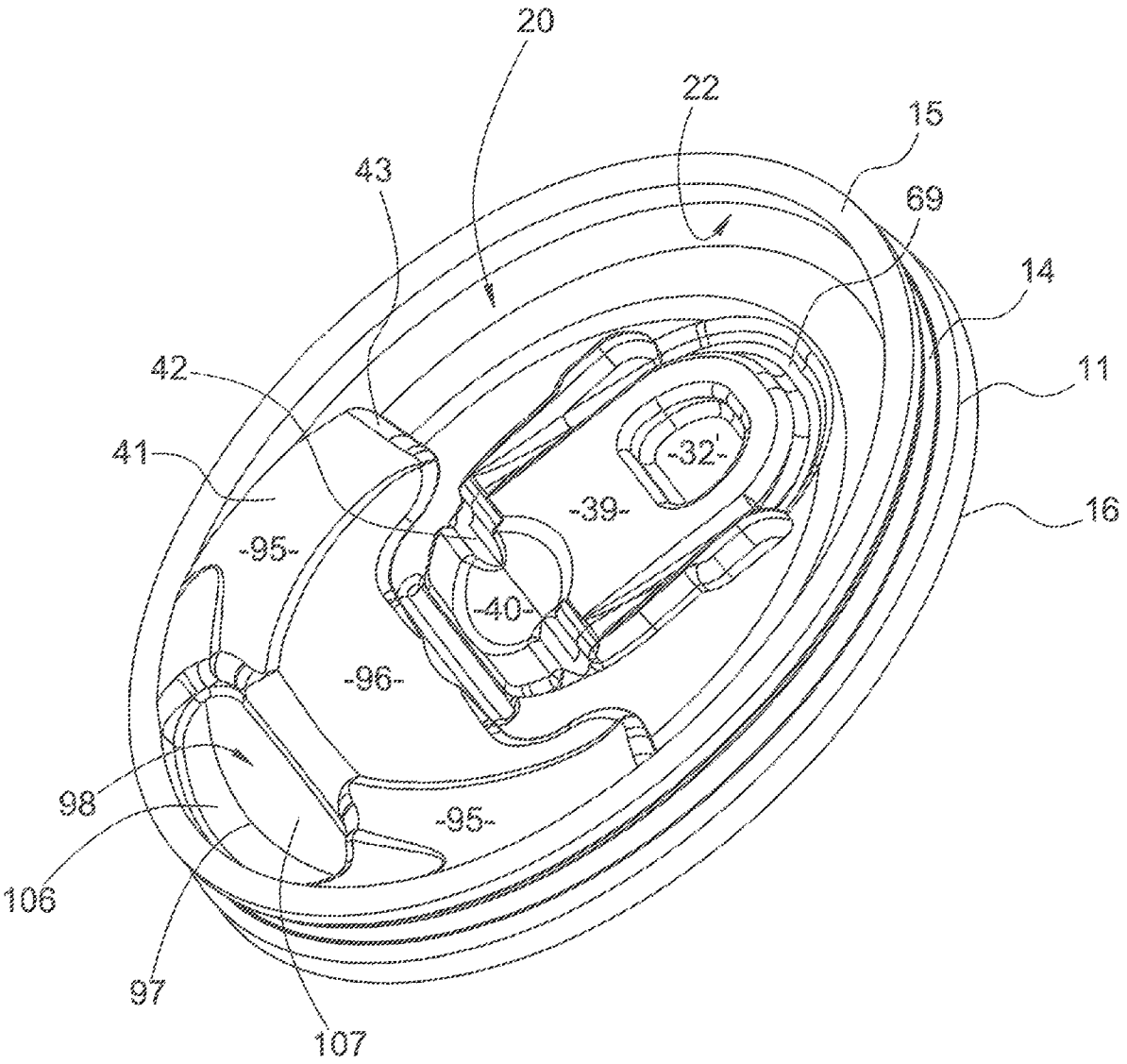
FIG. 29 is an anterior top perspective view of the third beverage can cap according to the present invention showing the third beverage can cap in a cap-closed configuration.
Figure 31:
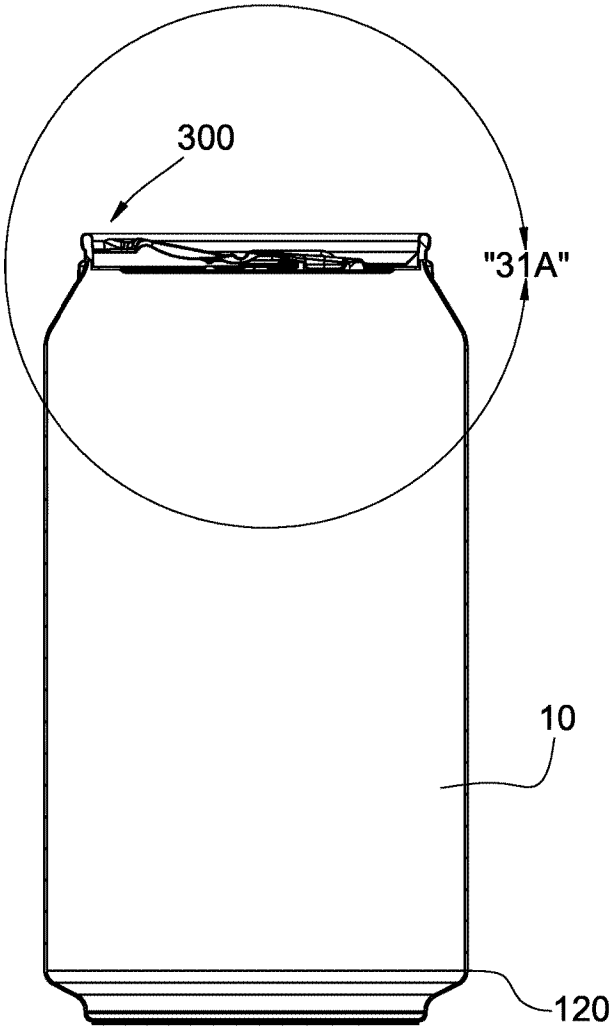
FIG. 31 is a medial longitudinal cross-sectional view of the third beverage can cap according to the present invention as outfitted upon a generic beverage can as sectioned from FIG. 30.
Figure 30:
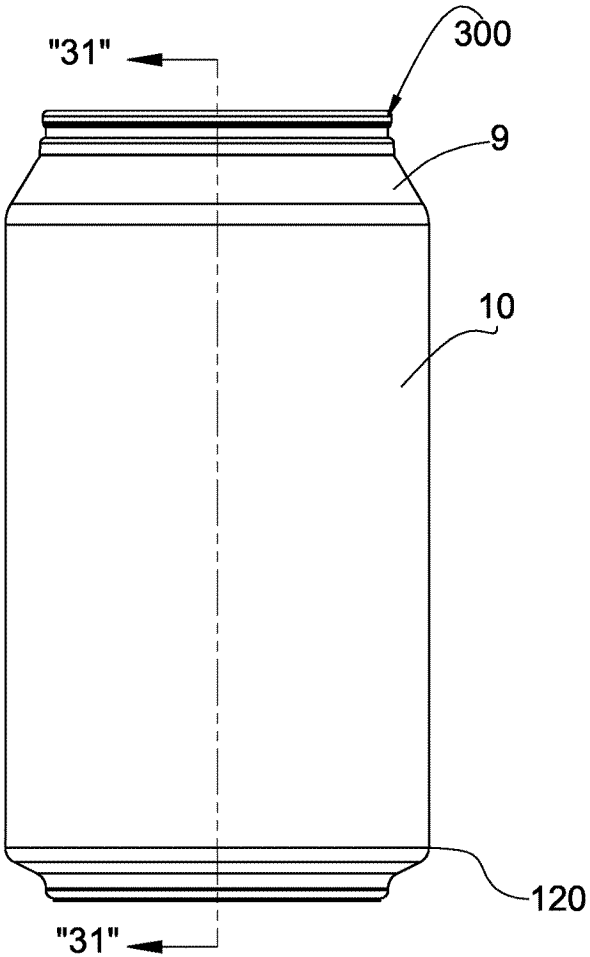
FIG. 30 is an anterior elevational view of the third beverage can cap according to the present invention as outfitted upon a generic beverage can.
Figure 31A:
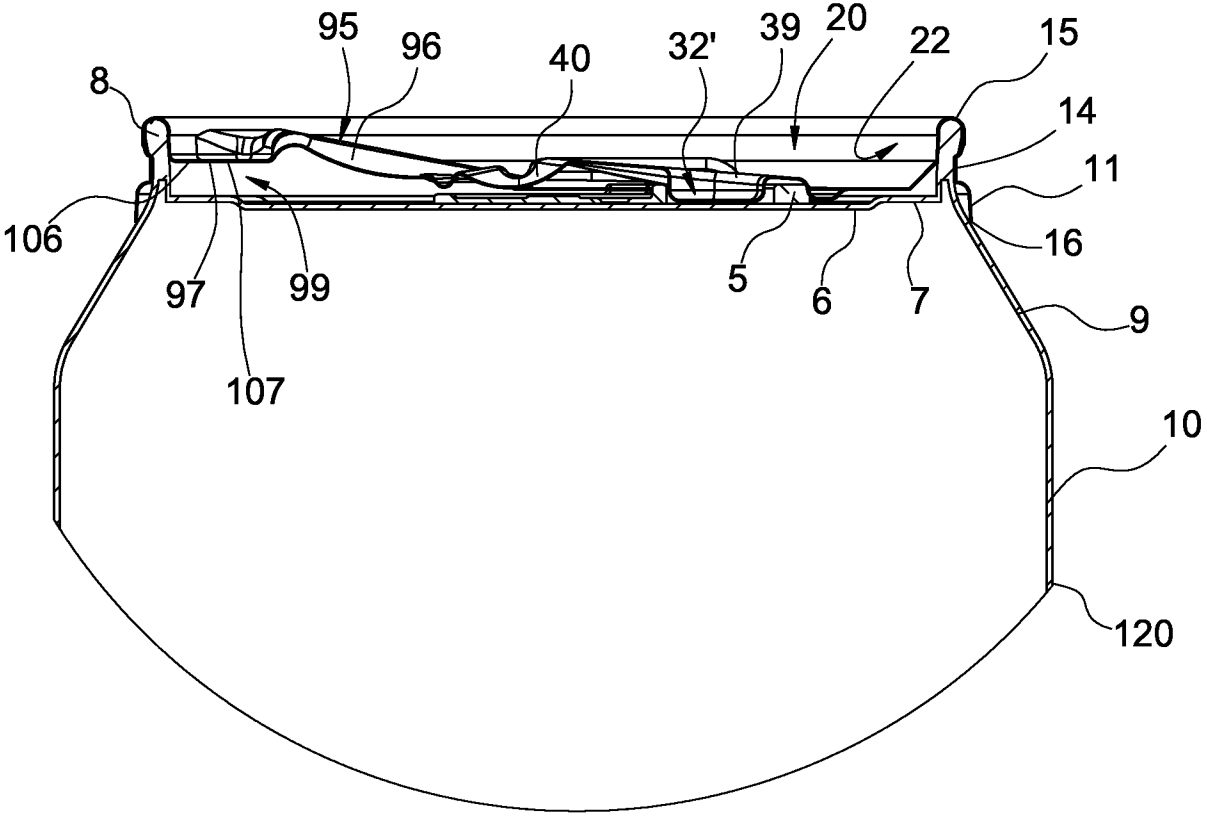
FIG. 31A is an enlarged fragmentary sectional view of the third beverage can cap as enlarged and sectioned from FIG. 31 to show in greater detail structures associated with the third beverage can cap relative to the generic beverage can.
Figure 32:
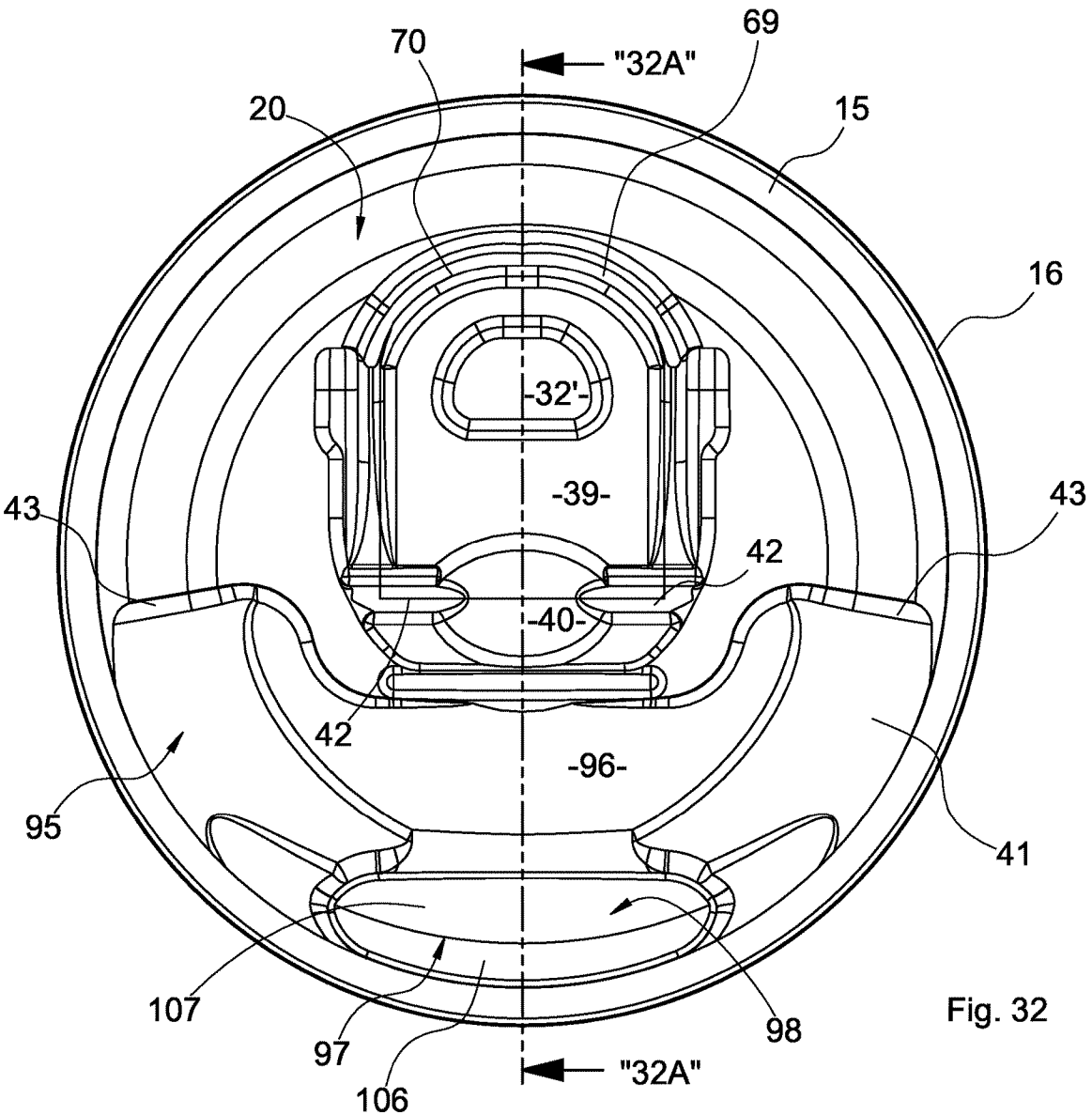
FIG. 32 is a top plan view of the third beverage can cap according to the present invention.
Figure 32A:
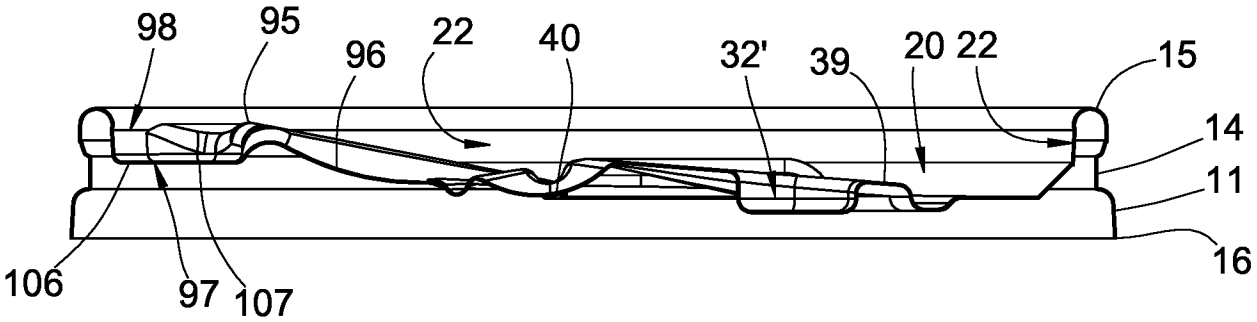
FIG. 32A is a medial longitudinal cross-sectional view of the third beverage can cap according to the present invention as sectioned from FIG. 32 to show in greater detail structures associated with the third beverage can cap.

The cap plug 30 fits into the cap opening 50 with the upper plug depression 35 preferably extending in parallel relation to the cap plate portion 20. The cap plug 30 tightly plugs into the beverage-letting aperture 3 such that the lower, exterior side wall 31 of cap plug 31 tightly engages the peripheral aperture edge 1 of the beverage-letting aperture 3. In other words, the upper, interior side wall 34 of the cap plug 30 depends from upper plug edge 36 and plug edge 36 engages the peripheral edge 37 of the cap aperture 50 such that the cap plug 30 extends into the beverage-letting aperture 3 thereby plugging both the beverage-letting aperture 3 and the cap opening 50 as generally depicted in FIG. 27A.

Figure 22:
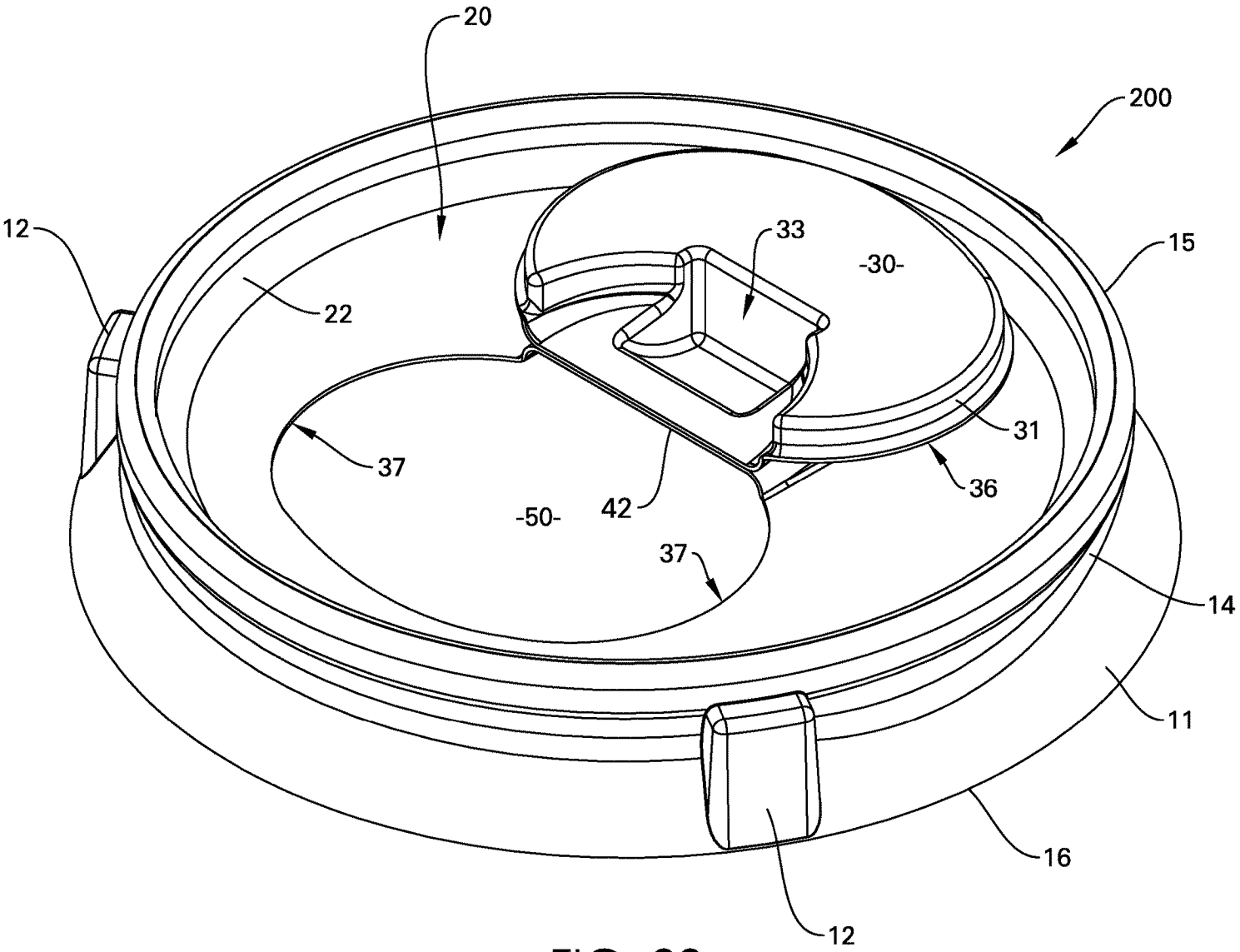
FIG. 22 is a third anterior top perspective view of the second beverage can cap according to the present invention showing the second beverage can cap in a second cap-open configuration.
Figure 25:
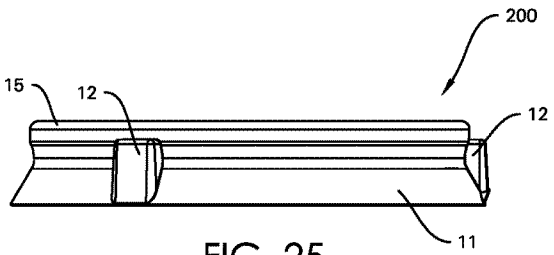
FIG. 25 is an offset anterior edge view of the second beverage can cap according to the present invention.
Figure 23:
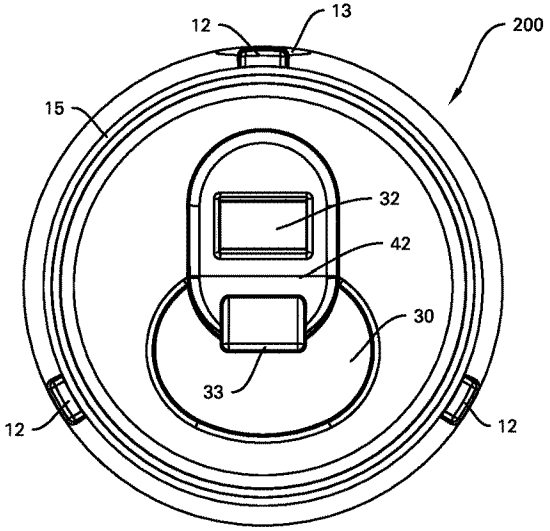
FIG. 23 is a top plan view of the second beverage can cap according to the present invention.
Figure 24:
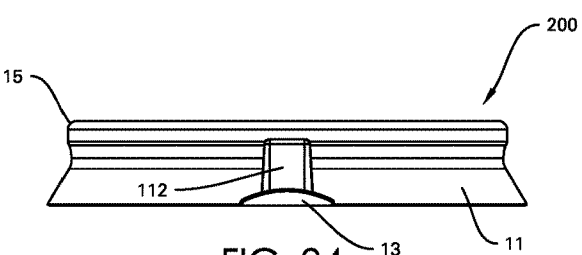
FIG. 24 is a posterior edge view of the second beverage can cap according to the present invention.
Figure 26:
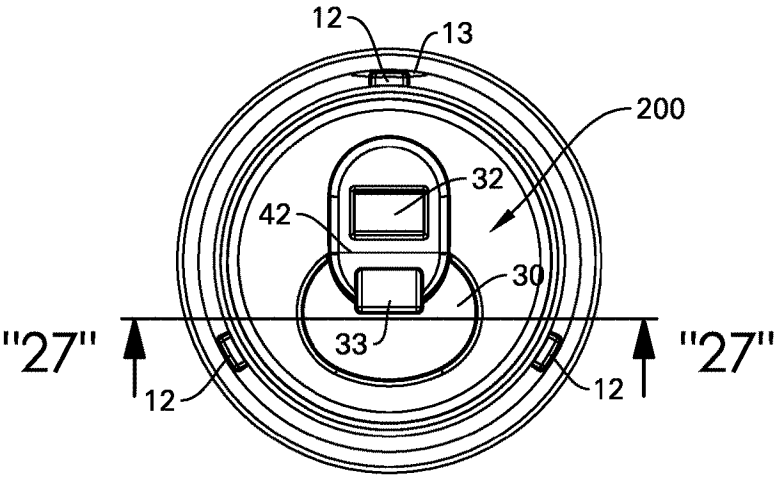
FIG. 26 is a top plan view of the second beverage can cap according to the present invention as outfitted upon a generic beverage can in a rotatable position for plugging the beverage-letting aperture of the generic beverage can and shown in side-by-side relation to imagery shown in FIG. 27 for ease of comparison.

In order to open the beverage can 120 as outfitted with the beverage can cap 200 in the cap-plugged configuration, the user may push up the male lock feature 33 in direction 38 and snugly inserts the male lock feature 33 in the female lock-receiving cavity 32 formed in the raised alternative tab element cover 23A. The snug fit between the female lock-receiving cavity 32 and male lock feature 33 maintains the plug in a cap-open position as generally depicted in FIGS. 22 and 22A until the user decides to close the beverage can cap 200 by pivoting the cap plug 30 back into the cap opening 50.

The cap plug 30 is preferably pivotally attached to the alternative raised tab element cover 23A via a living hinge type mechanism as at 42.

The third alternative beverage can cap 300 according to the present invention preferably also comprises a lower cap skirt 11; an upper cap rim 15; an inwardly extending cap groove 14 intermediate the lower cap skirt 11 and the upper cap rim 15; and a cap plate portion 20 centrally located relative to the upper cap rim 15 generally extending in a cap plate plane 112. The third alternative beverage can cap 300 differs from the first and second alternative can caps 100 and 200 primarily by providing a relatively more complex beverage-letting mechanism 41 as compared to the relatively basic cap opening 50 of the first alternative beverage can cap 100, and as compared to the pluggable can-opening 50 of second alternative can cap 200.

The reader will note that the third embodiment or third alternative beverage can cap 300 eliminates the cap-turning nubs 12 since rotation is not key to its functionality. Further, the lower cap skirt 11 is relatively much shorter in length as compared to the lower cap skirts 11 of beverage can caps 100 and 200 in order to keep the beverage can cap 300 as tight as possible on the upper can portion when affixed thereto.

The reader will note that one of the biggest advantages of beverage can cap 300 as compared to beverage can caps 100 and 200 is that the beverage can cap 300 will normally remain affixed to the upper can portion from packaging through sales, consumption, and disposal with no need to remove the beverage can cap 300 in order to open the beverage can 120. Disposal of the beverage can cap 300 as fixedly attached to aluminum can helps ensure recyclability of the beverage can cap 300 as aluminum cans are among the best recycled product in circulation thereby more often carrying the beverage can caps 300 to recycling processes.

The upper cap rim 15 receives the upper can rim 8 of the beverage can 120; the cap plate portion 20 extends in parallel relation to the can capping plate 7; and the beverage-letting mechanism 41 overlies the scored plate portion 4 of the beverage can 120 prior to scored plate portion 4 depression; and the inwardly extending cap groove 14 resiliently engages the can groove 17 via the inherent resiliency of the material construction for enhancing cap-to-can attachment.

The third alternative beverage can cap 300 essentially eliminates the cap plug 30 feature of beverage can cap 200, and instead provides the pivotable beverage-letting mechanism 41 coextensively formed with the cap plate portion 20 and primarily operable via a user's mouth for controlling beverage or liquid flow 108 from the beverage can 120. The third alternative beverage can cap 300 further provides a relatively more complex tab element cover as at 39 that is positioned in superior adjacency to the can-opening tab element 5.

As noted above, the beverage can cap 300 eliminates the circumferentially spaced cap-turning nubs otherwise referenced at 12 in connection with beverage can caps 100 and 200, as well as the at least one flange-like grip formation as referenced at 13. Whereas the first and second alternative beverage can caps 100 and 200 are removably and rotatably attachable to the upper can portion or lid portion of the beverage can 120, it is contemplated that the third alternative beverage can cap 300 may be preferably affixed to the beverage can 120 at the time of packaging as more of a permanently affixed beverage can cap with a lesser need for removing and/or rotating the beverage can cap 300 given the enhanced beverage-letting functionality of the beverage can cap 300.

The user may open the beverage can 120 by way of the can-opening tab element 5 and swinging or pivoting tab element cover 39 that pivots via a living hinge mechanism as at 42. The beverage can cap 300 may preferably comprise a slot (optionally perforated or scored although not specifically illustrated) as at 69 for enabling the user to grip an cover edge 70 of the pivoting tab element cover 39 overlying the can-opening tab element 5.

The lever-like first opener end 116 is accessible via the slot 69 enabling the user to grip the lever-like first opener end 116 in order to open the beverage can 120 as described above and as is well known in the art. As prefaced above, it is further contemplated that the tab element cover 39 of the beverage can cap 300 may be provided with a perforated outer edge (or otherwise outfitted with a notched outer perimeter or edge) for enabling the user to break the perforation if desired by the user by pulling up on the outer peripheral cover edge 70 (not specifically illustrated).

Figure 33:
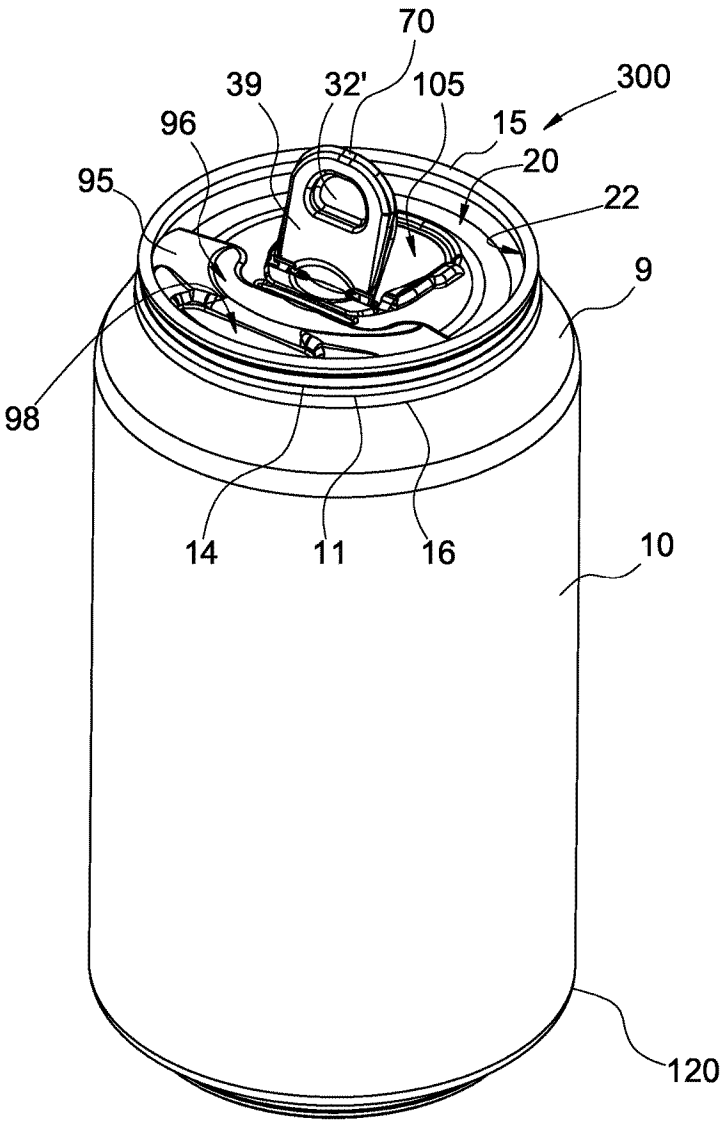
FIG. 33 is a second top perspective view of a generic beverage can outfitted with the third beverage can cap according to the present invention showing the third beverage can cap in a can-opening configuration.
Figure 35:
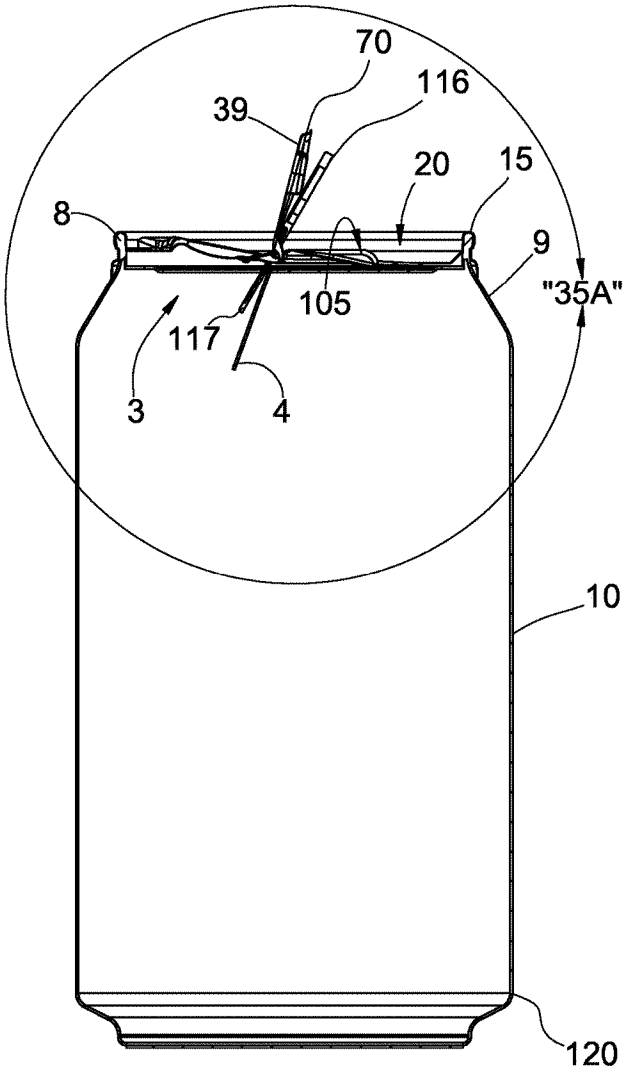
FIG. 35 is a medial longitudinal cross-sectional view of the third beverage can cap according to the present invention as outfitted upon a generic beverage can as sectioned from FIG. 34.
Figure 34:
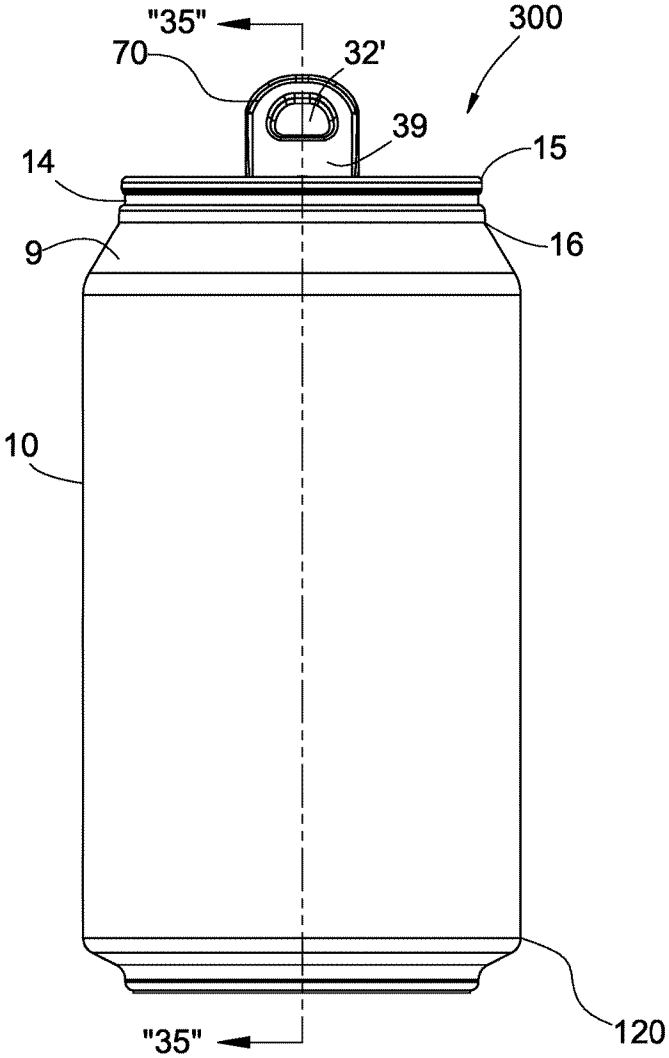
FIG. 34 is an anterior elevational view of the third beverage can cap according to the present invention as outfitted upon a generic beverage can and shown in the can-opening configuration.
Figure 35A:
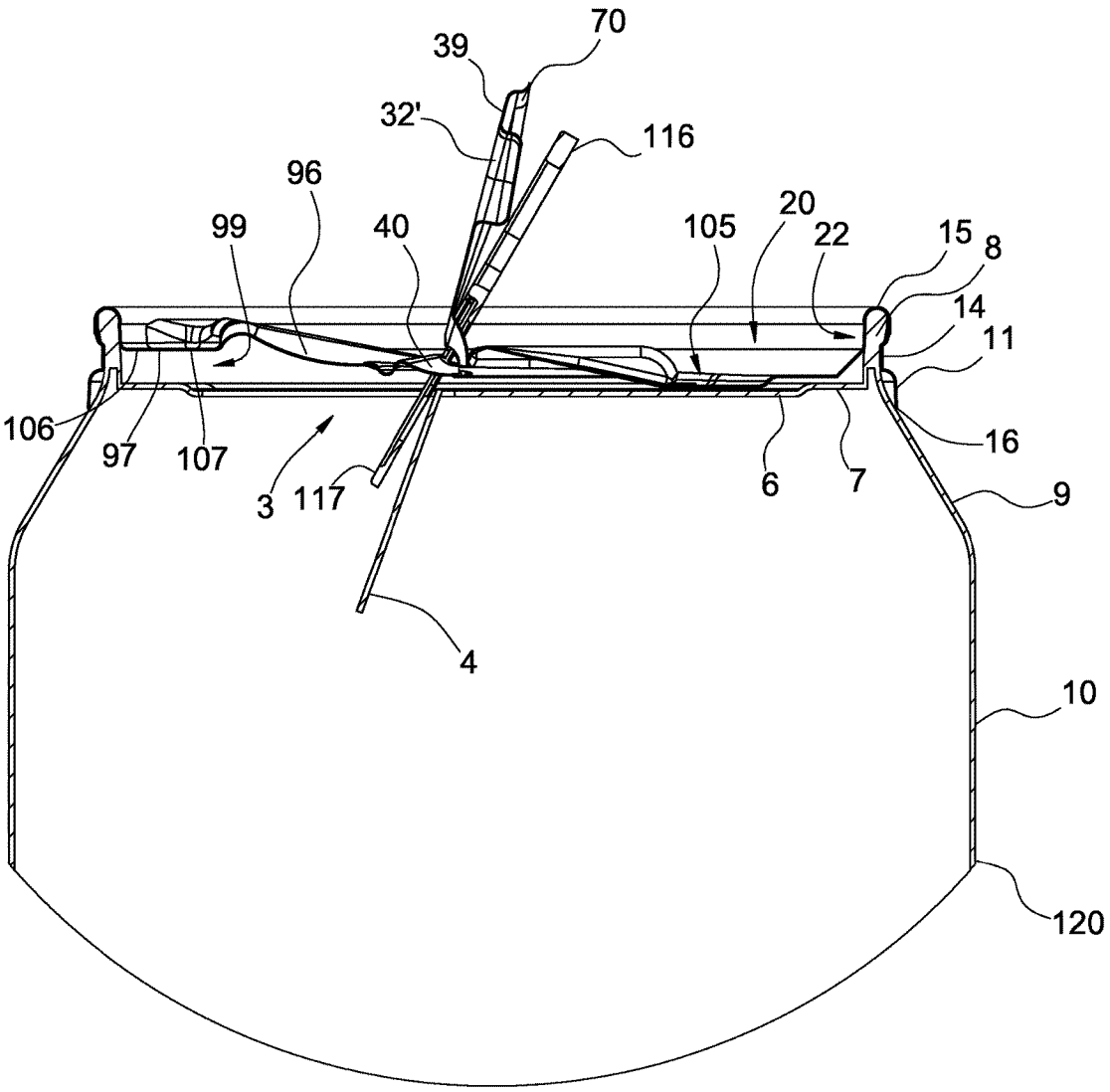
FIG. 35A is an enlarged fragmentary sectional view of the third beverage can cap as enlarged and sectioned from FIG. 35 to show in greater detail structures associated with the third beverage can cap relative to the generic beverage can when in the can-opening configuration.
Figure 36:
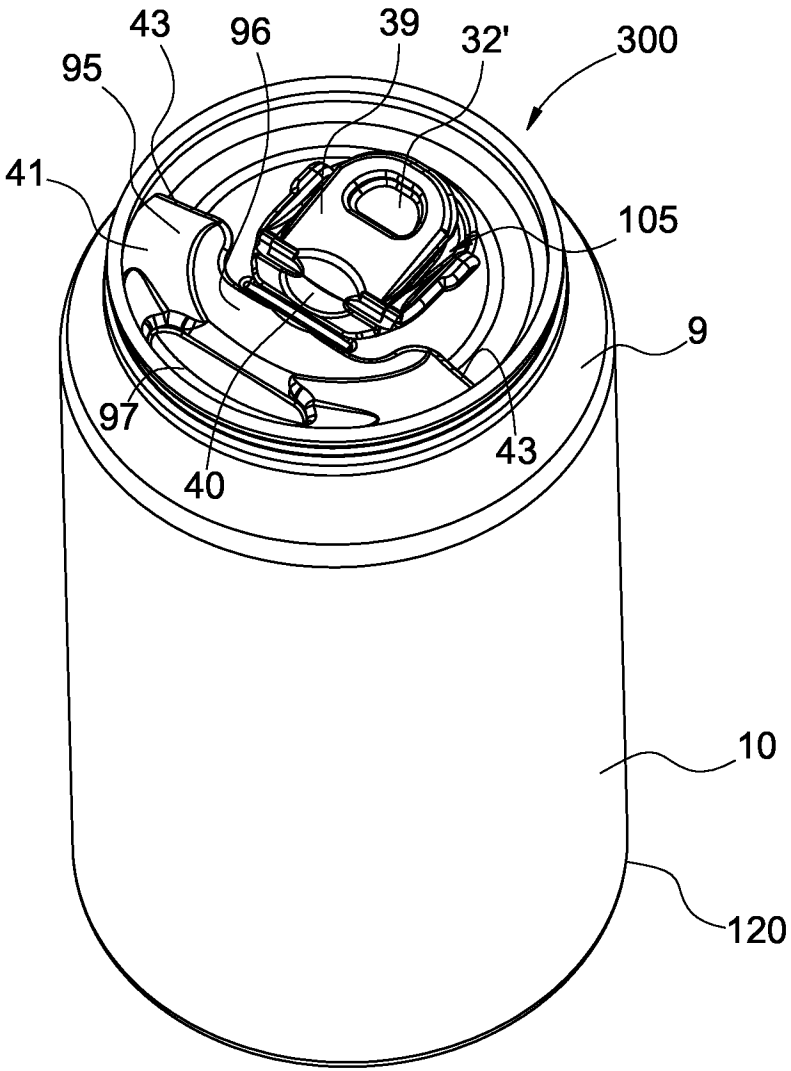
FIG. 36 is a third top perspective view of a generic beverage can outfitted with the third beverage can cap according to the present invention showing the third beverage can cap in a can-opened configuration.
Figure 36A:
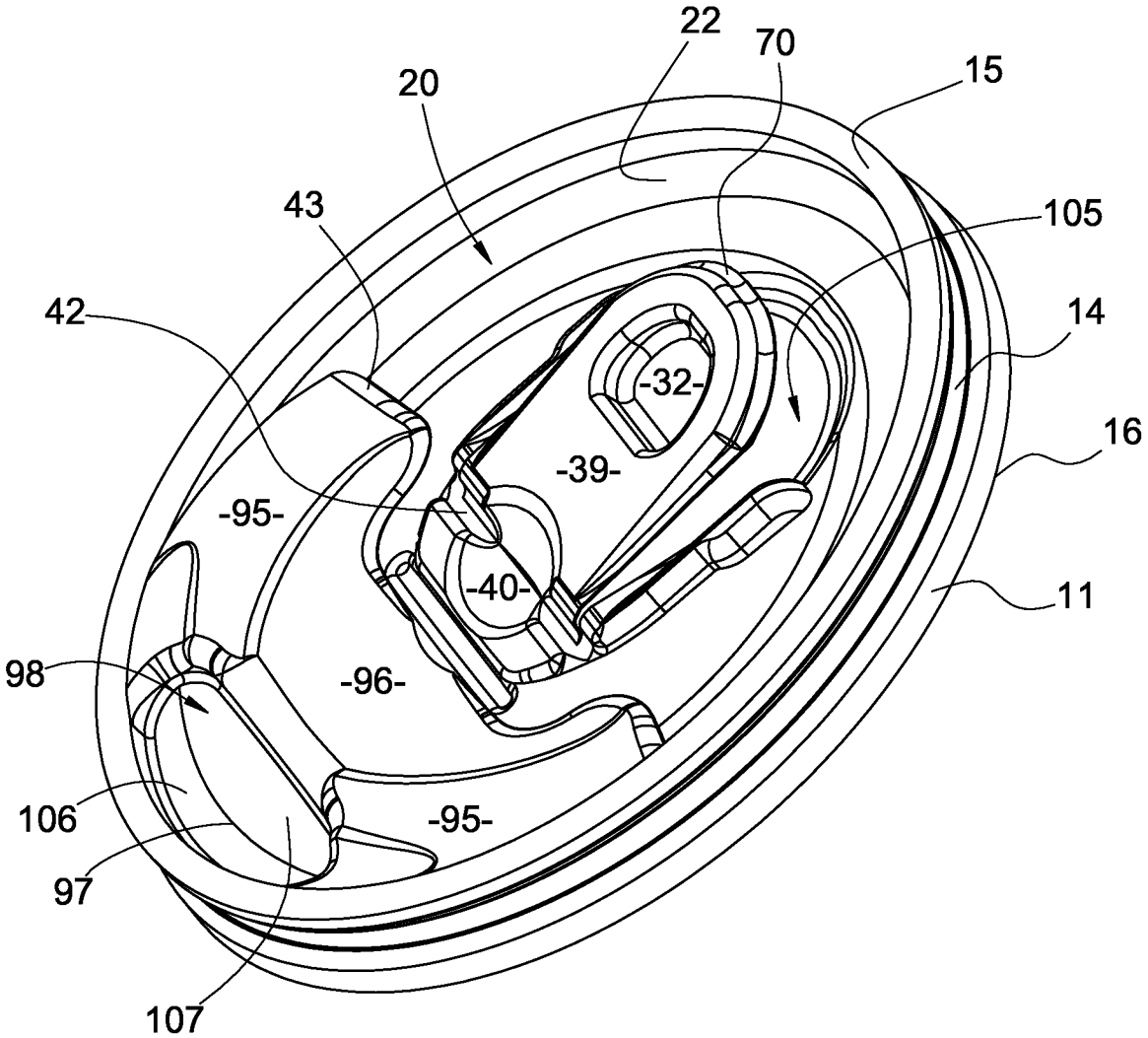
FIG. 36A is a top perspective view of the third beverage can cap according to the present invention showing the third beverage can cap in the can-opened configuration.
Figure 38:
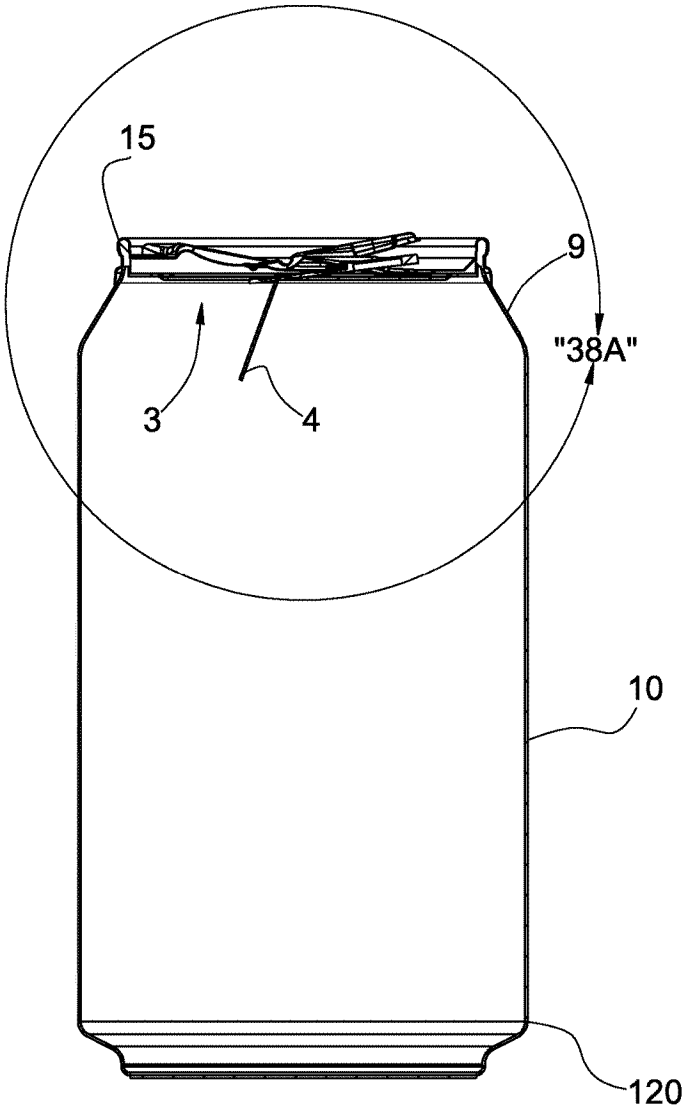
FIG. 38 is a medial longitudinal cross-sectional view of the third beverage can cap according to the present invention as outfitted upon a generic beverage can as sectioned from FIG. 37.
Figure 37:
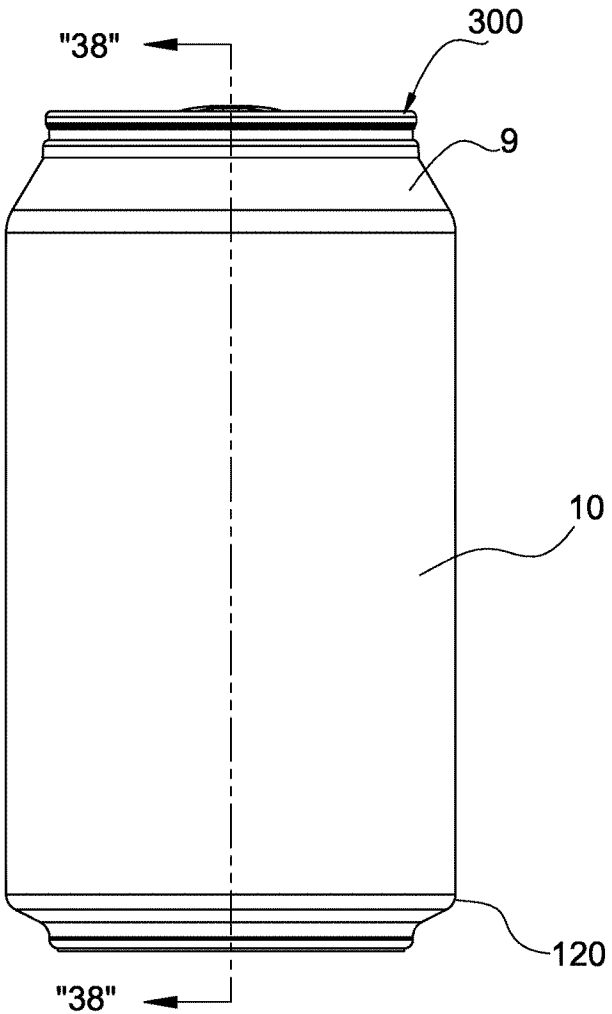
FIG. 37 is an anterior elevational view of the third beverage can cap according to the present invention as outfitted upon a generic beverage can and shown in the can-opened configuration.
Figure 38A:
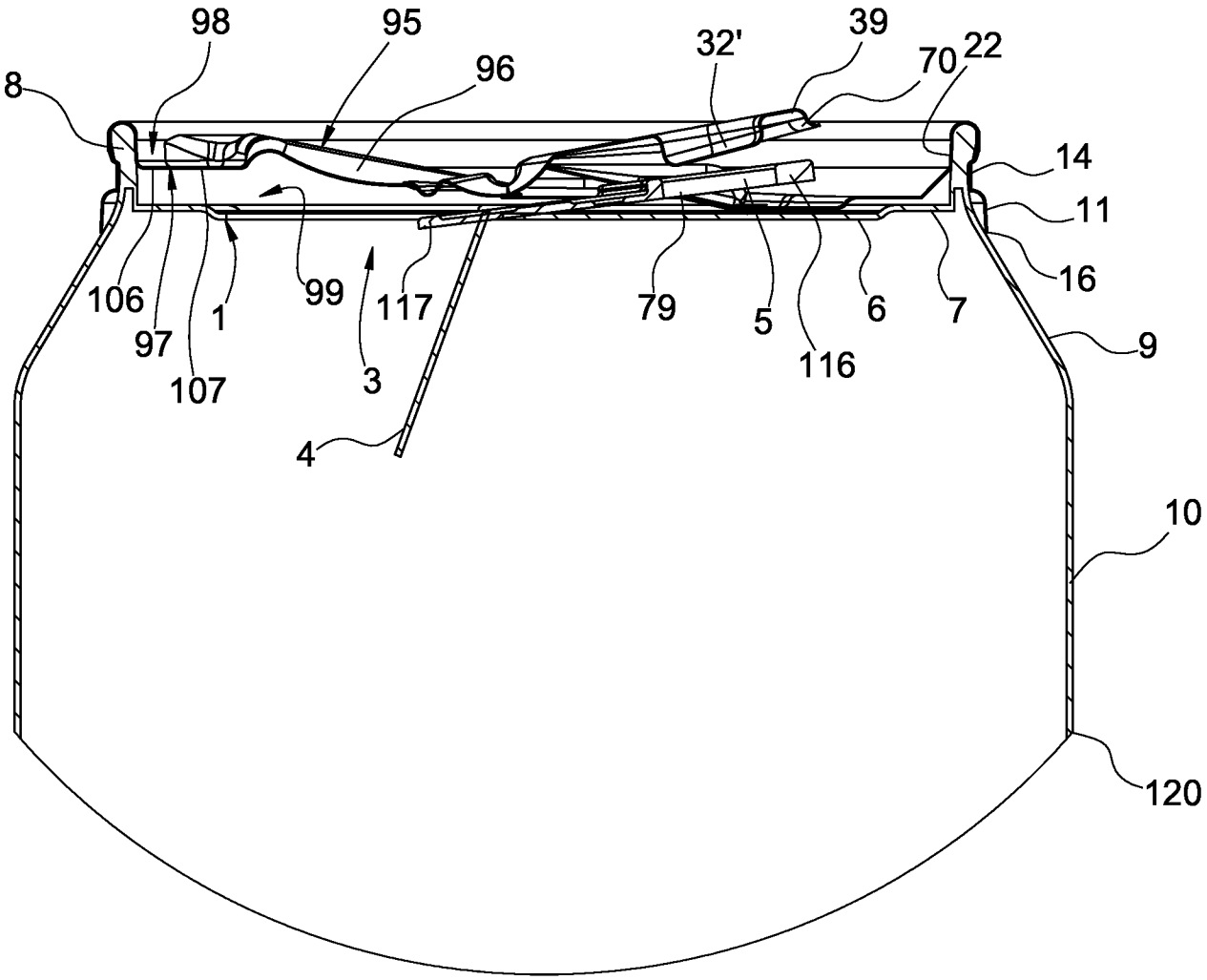
FIG. 38A is an enlarged fragmentary sectional view of the third beverage can cap as enlarged and sectioned from FIG. 38 to show in greater detail structures associated with the third beverage can cap relative to the generic beverage can when in the can-opened configuration.
Figure 39:
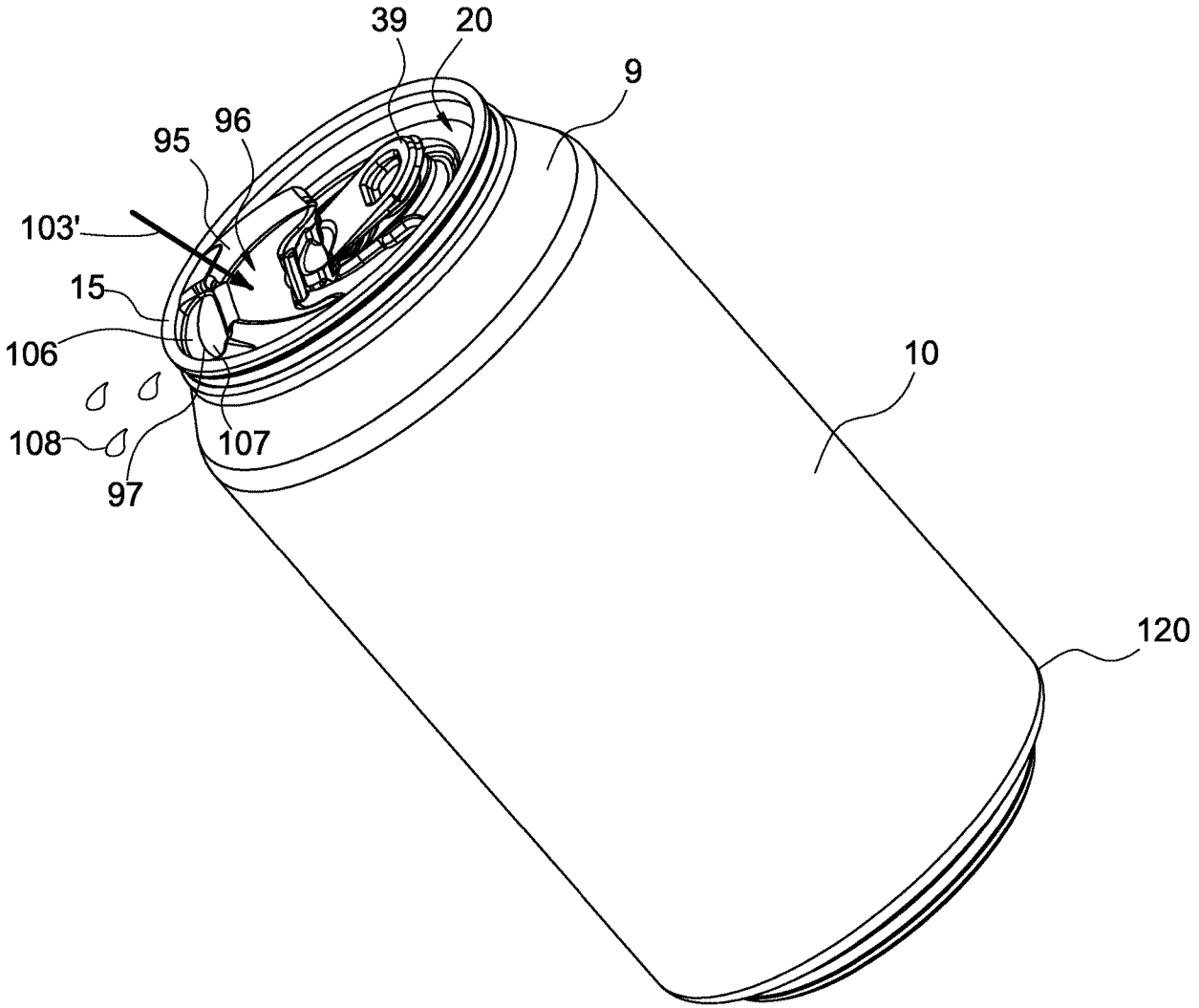
FIG. 39 is a fourth top perspective view of a generic beverage can outfitted with the third beverage can cap according to the present invention showing the third beverage can cap in the can-opened configuration with a beverage flow from the beverage can via the third beverage can cap.

The depression 40 is designed to receive a fingertip for aiding the user during can-opening functions. A user may direct force into the living hinge mechanism 42 at the depression 40 to add pressure over the lever-like second opener end 117 and to raise the cover edge 70 for better accessing the lever-like first opener end 116. The swinging or pivoting tab element cover 39 moves or pivots in much the same arcuate movement as the can-opening tab element 5 and when the scored plate portion 4 is depressed, a pivot cover opening 105 is formed as depicted in FIG. 33.

Viewed exteriorly, the tab-engaging depression 32' of the swinging cover 39 provides male engagement structure as a tab-engaging protrusion 32' interiorly and is received by the female gap or tab element aperture 79 of the can-opening tab element 5 thereby interlocking the swinging or pivoting tab element cover 39 and the can-opening tab element 5. After the beverage can 120 is opened, the can-opening tab element 5, interlocked with the swinging or pivoting tab element cover 39, may be returned to its relaxed prone position as is usually done and as is well understood in the art. At that moment the beverage-letting aperture 3 is covered by the pivotable beverage-letting mechanism 41 of the beverage can cap 300.

Figure 40:
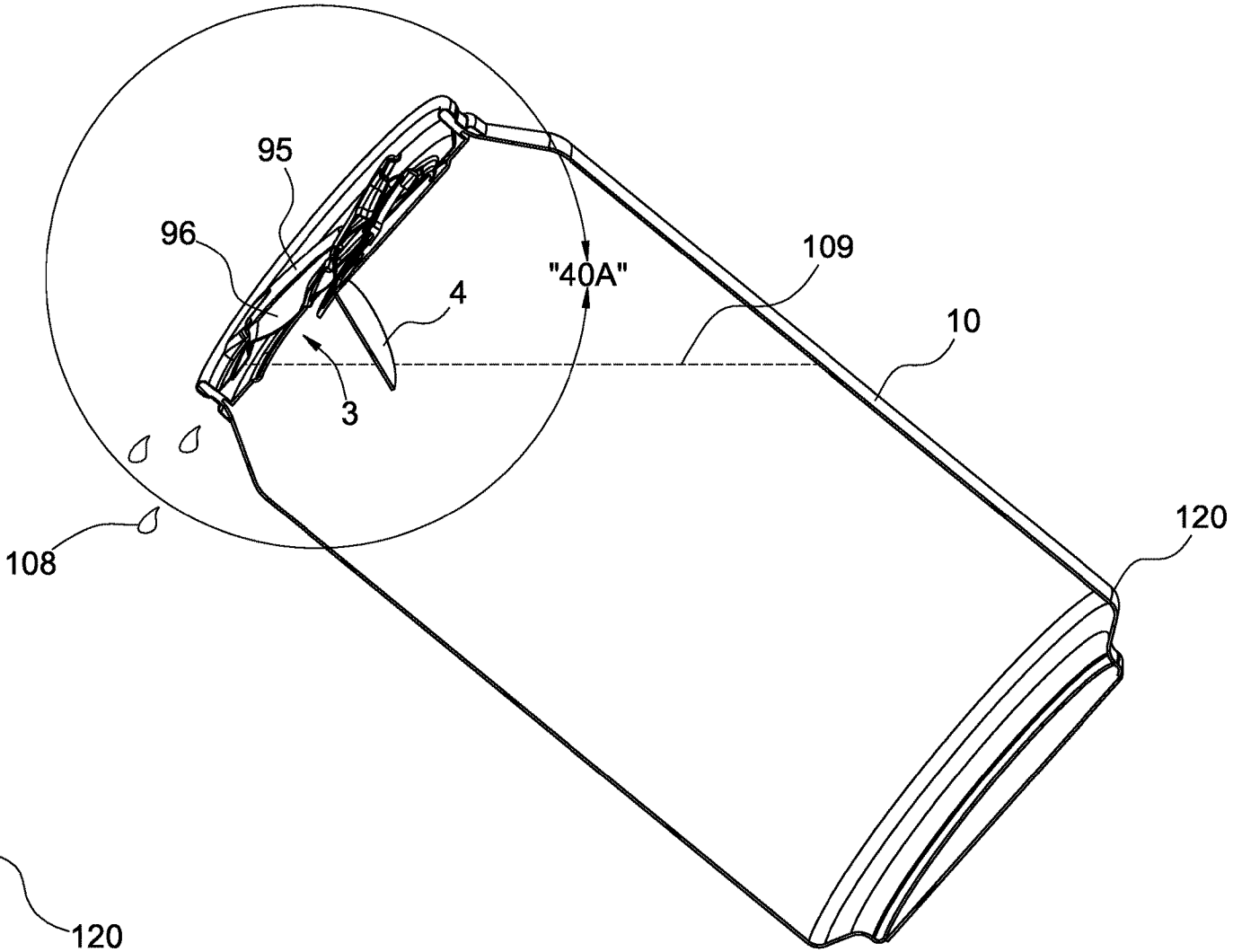
FIG. 40 is a medial longitudinal cross-sectional perspective view of the third beverage can cap according to the present invention as outfitted upon a generic beverage can as sectioned from FIG. 39 and shown in side-by-side relation to imagery of FIG. 39A for ease of comparison.
Figure 39A:
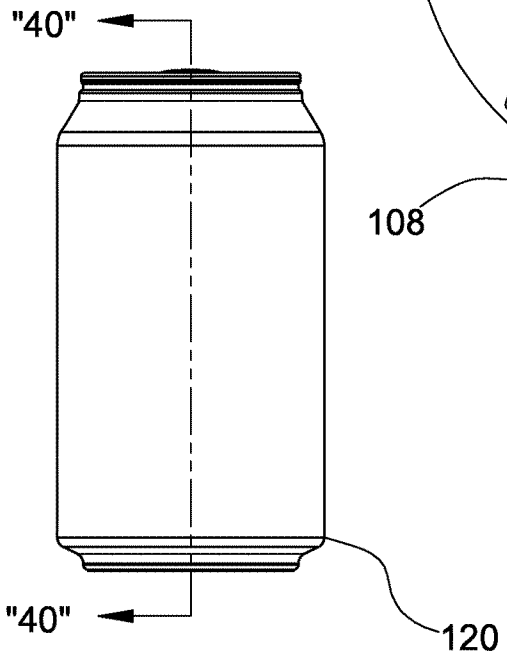
FIG. 39A is a reduced anterior elevational view of the third beverage can cap according to the present invention as outfitted upon a generic beverage can and shown in the can-opened configuration in side-by-side relation to imagery of FIG. 40 for ease of comparison.
Figure 40A:
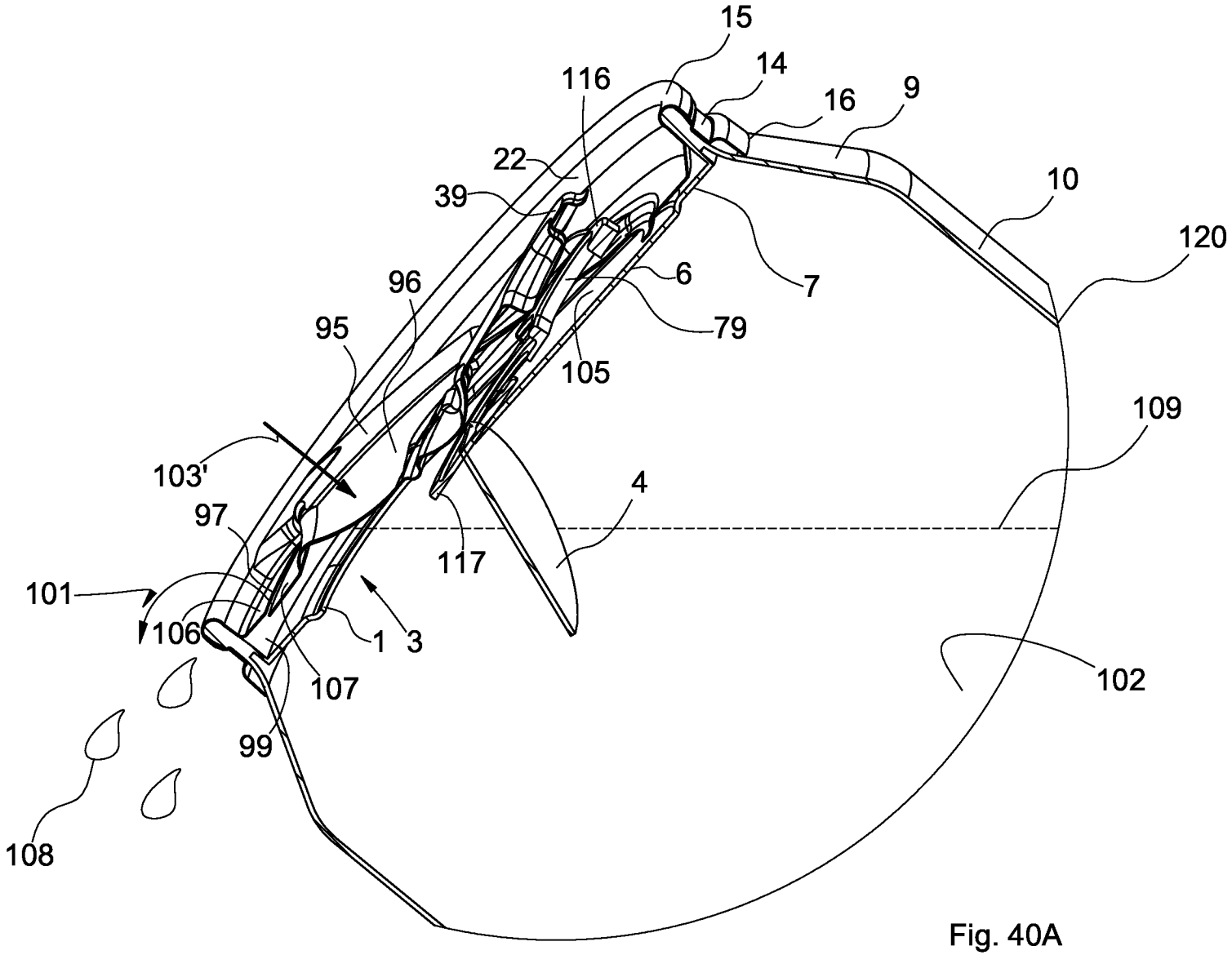
FIG. 40A is an enlarged fragmentary sectional view of the third beverage can cap as enlarged and sectioned from FIG. 40 to show in greater detail structures associated with the third beverage can cap relative to the generic beverage can when in the can-opened configuration.
Figure 40B:
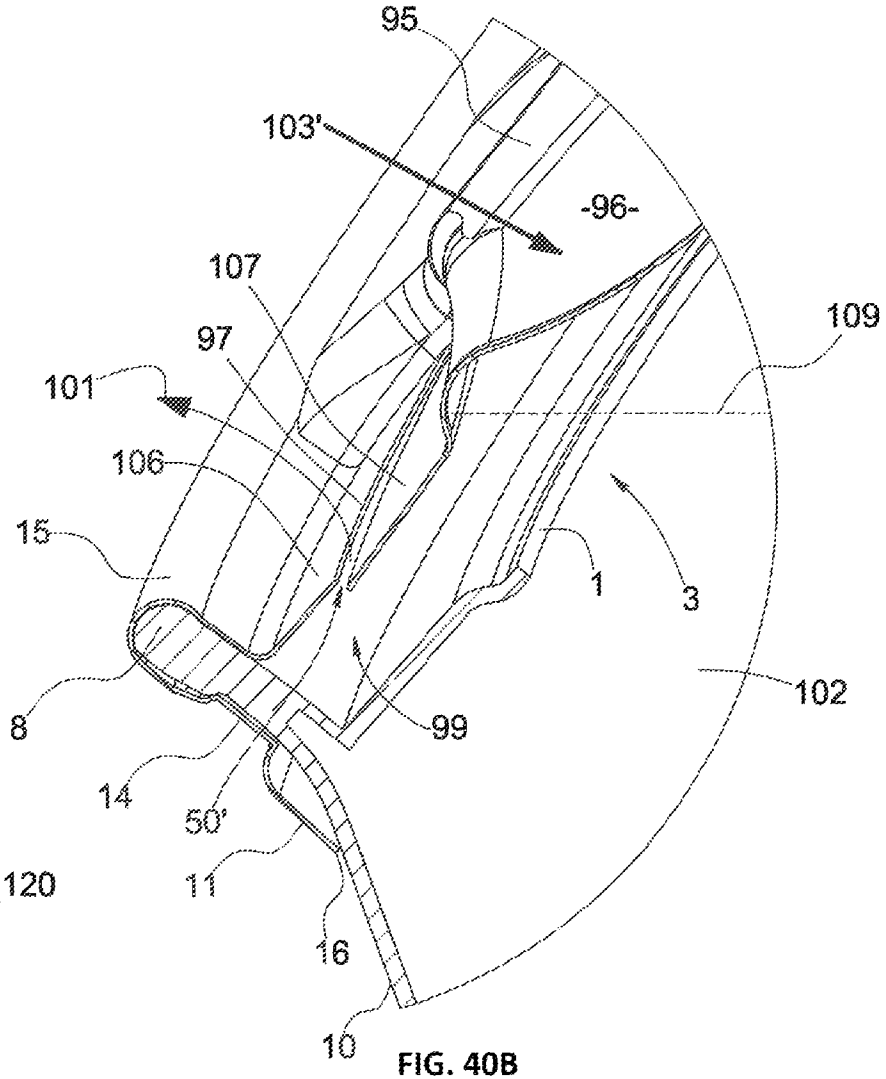
FIG. 40B is an enlarged fragmentary sectional view of the third beverage can cap as enlarged and sectioned from FIG. 40C to show in greater detail structures associated with the third beverage can cap relative to the generic beverage can when in the can-opened configuration.
Figure 40C:
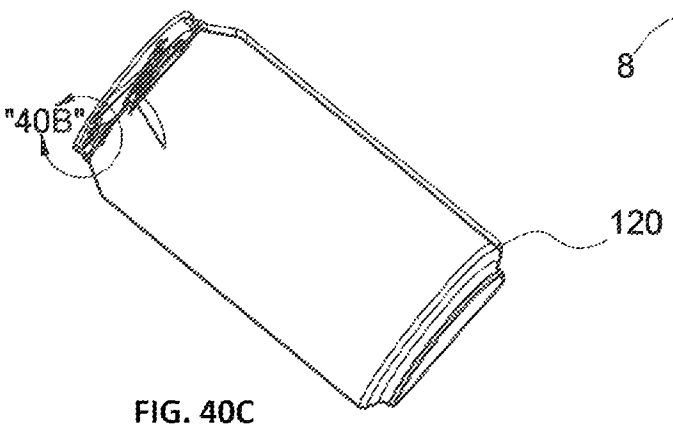
FIG. 40C is a reduced medial longitudinal cross-sectional perspective view of the third beverage can cap according to the present invention as outfitted upon a generic beverage can as reduced from FIG. 40 and shown in side-by-side relation to imagery of FIG. 40B for ease of comparison.
Figure 41:
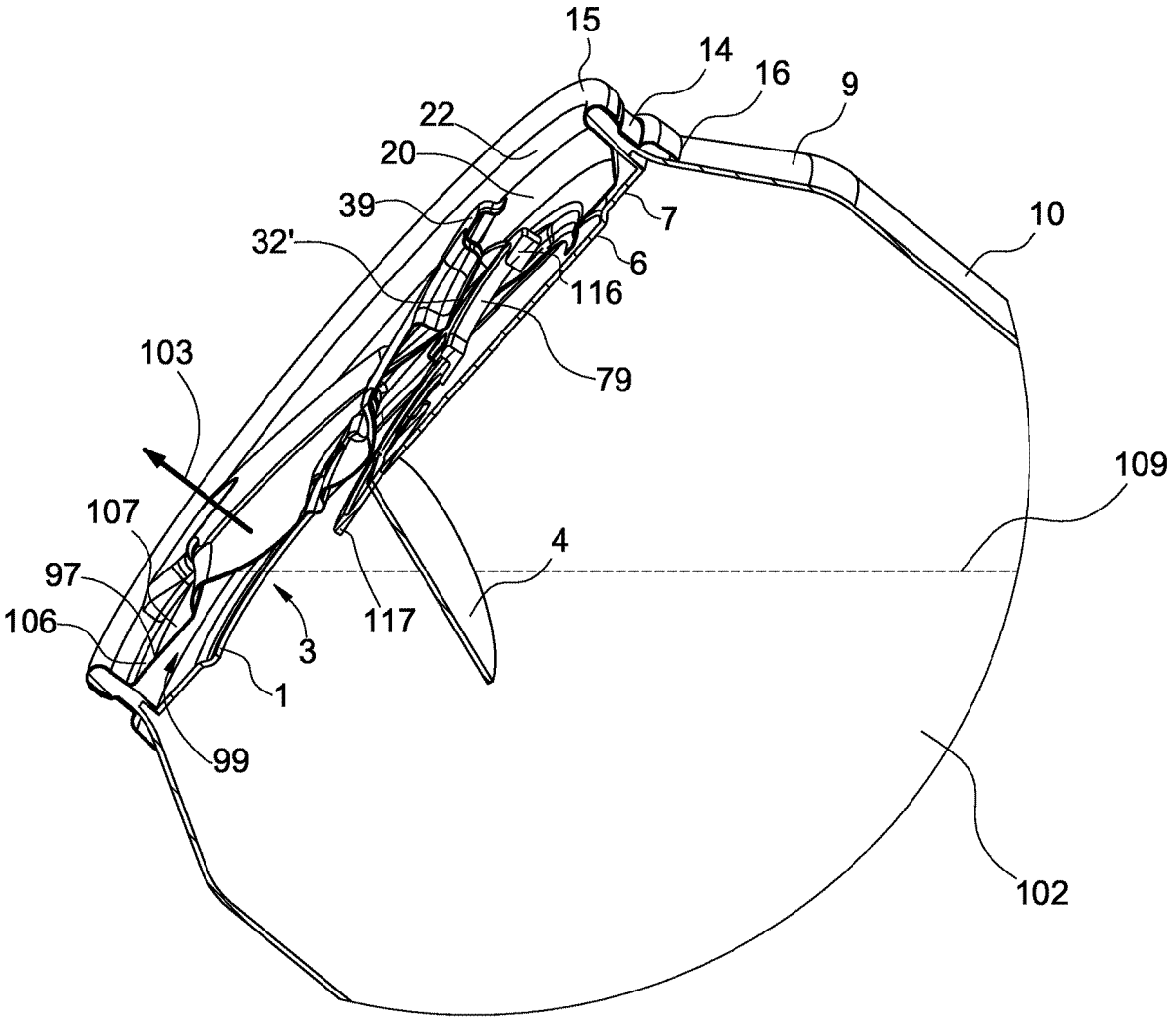
FIG. 41 is an enlarged fragmentary sectional view of the third beverage can cap as enlarged to show in greater detail structures associated with the third beverage can cap relative to the generic beverage can when in the can-opened configuration and in a cap-relaxed configuration.
Figures 41A, 41B:
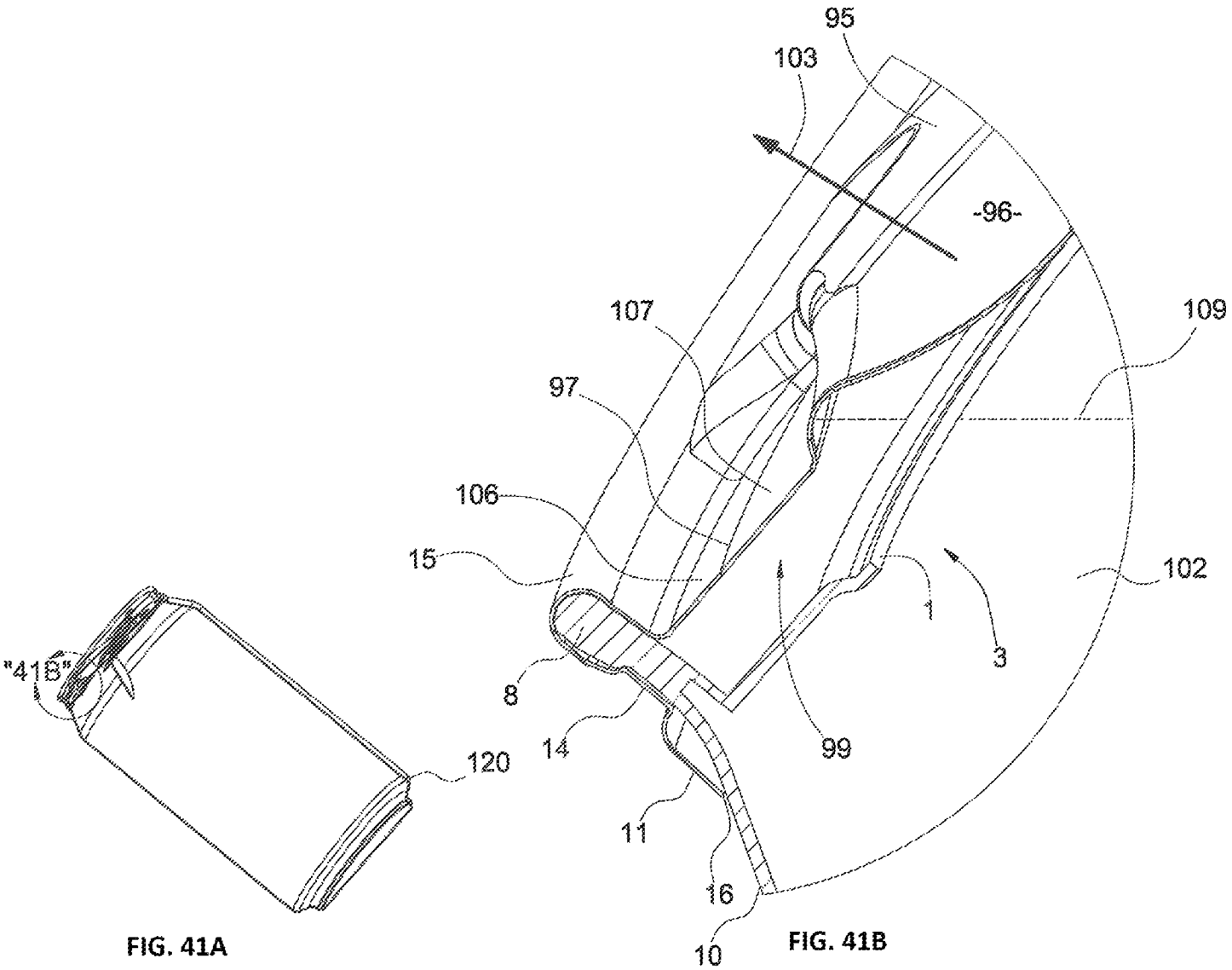
FIG. 41A is a reduced medial longitudinal cross-sectional perspective view of the third beverage can cap according to the present invention as outfitted upon a generic beverage can and shown in side-by-side relation to imagery of FIG. 41B for ease of comparison.
FIG. 41B is an enlarged fragmentary sectional view of the third beverage can cap as enlarged to show in greater detail structures associated with the third beverage can cap relative to the generic beverage can when in the can-opened, cap-relaxed configuration.

Recalling that the third alternative beverage can cap 300 is preferably constructed from resilient and flexible thermoplastic material and attached to the beverage can 120 at the time of packaging, the beverage consumer may operate the beverage-letting mechanism 41 by tilting the beverage can 120 and drinking beverage flow 108 by sipping beverage through slit opening or beverage-letting gap 50' as generally depicted and referenced in FIG. 40B. The reader will further note an exemplary beverage level 109 during the tilting action in FIGS. 40, 40A, 40B, 41, and 41B.

The beverage consumer's upper lip (represented at vector arrow 103') directs force into lip landing structure 96 flanked by raised frontal protrusion structures 95 thereby depressing a displaceable portion 107 at the slit cut 97 while an anterior fixed portion 106 remains in place creating the slit opening or beverage-letting gap 50' for letting or enabling beverage flow 108. A depression 98 preferably embraces both the displaceable portion 107 and the fixed portion 106 structurally signifying the beverage flow site.

In other words, the can-contained beverage 102 flows as at 108 through space 99 and outlets through cap slit opening or beverage-letting gap 50' in liquid flow directions 101 as generally and comparatively depicted in FIGS. 40 and 40A. When force/pressure from the beverage consumer's upper lip is removed, the inherent resiliency of the material construction returns (as represented as vector 103) the displaceable portion 107 thereby closing the slit opening or beverage-letting gap 50' at slit cut line 97 for preventing beverage leakage. The resilient beverage-letting mechanism 41 is thus resiliently actuable for forming the beverage-letting gap 50' and relaxable for closing the beverage-letting gap 50'. The resilient beverage-letting mechanism 41 thus enables the user to control beverage flow 108 via the beverage-letting gap 50' from the beverage can 120 as outfitted with the beverage can cap 300.

It is contemplated that the third alternative beverage can cap 300 is particularly beneficial for use by children. Parents or caregivers may open the outfitted beverage can 120 and give the opened beverage can 120 for the child to consume the beverage with the resilient leak prevention mechanism as described hereinabove. Further, the beverage can cap 300 is designed for difficult removal from the upper can portion for enhancing leak prevention. Other contemplated application scenarios include use scenarios where tamper prevention is paramount such as in night clubs and airlines.

The alternative swinging or pivoting tab element cover 39 extends upwardly from the cap plate portion 20 and is dimensioned for inferiorly or interiorly receiving the can-opening tab element 5. The swinging or pivoting tab element cover 39 comprises a tab-engaging protrusion as at 32', the tab-engaging protrusion 32' being insertable into a tab element aperture 79 formed in a can-opening tab element 5 for securing the tab element cover 39 to the can-opening tab element 5. The resilient beverage-letting mechanism 41 may be pivotally attached to the cap plate 20 via laterally opposed living hinge mechanisms as at 43. The living hinge mechanisms or hinges 43 cooperate with the inherent resiliency of the material construction for enhancing resilient action of the beverage-letting mechanism 41.

While the above descriptions contain much specificity, this specificity should not be construed as limitations on the scope of the invention, but rather as an exemplification of the invention. In certain embodiments, the basic invention may be said to essentially teach or disclose a beverage can cap as variously exemplified for outfitting a beverage can as at 120 enabling a user to selectively cover an upper can portion of the beverage can 120 and/or for controlling beverage flow from a beverage can 120 as outfitted with the various beverage can caps. The upper can portion of the beverage can 120 usable in combination with the beverage can cap(s) according to the present invention is believed to essentially comprise an upper can rim as at 8, a can capping plate as at 7, and a can neck portion as at 9.

In a first embodiment, the beverage can cap 100 according to the present invention preferably comprises a lower cap skirt as at 11, an upper cap rim as at 15, a cap plate as at 20 centrally located relative to the cap rim 15, and a cap opening 50 formed in the cap plate 20. The beverage can cap 100 is removably and rotatably attachable to the upper can portion of the beverage can 120 such that the upper cap rim 15 receives the upper can rim 8; the cap plate 20 extends in parallel relation to the can capping plate 7 and the lower cap skirt 11 seats down upon the can neck portion 9. The beverage can cap 100 is rotatable about a cap axis of rotation as at 110 for selectively positioning the cap plate 20 in superior adjacency to a beverage-letting aperture 3 formable in the can capping plate 7 for selectively covering the beverage-letting aperture 3 with a portion of the cap plate 20.

The reader will recall that the frustoconical can neck portion 9 may extend obliquely relative to the can capping plate 7 in various beverage cans 120. The lower cap skirt 11 may preferably and similarly extend obliquely relative to the cap plate portion or cap plate 20 such that the lower cap skirt 11 parallels the can neck portion 9. The frustoconical can neck portion 9 comprises an upper neck portion as at 19 and a lower neck portion as at 21. In view of this structural peculiarity, the lower cap skirt 11 is contemplated to preferably comprise a lower skirt edge as at 16 that terminates downwardly intermediate the upper and lower neck portions 19 and 21 for enhancing safe use of the beverage can cap 100 during cap rotation preventing any sharp edge portions of the lower skirt edge 16 from directly contacting or engaging the user's hands during cap-turning movements or actions.

The beverage can cap 100 may further preferably comprise at least one, but preferably a series of circumferentially spaced cap-turning nubs as at 12 for enhancing a user's ability to rotate the beverage can cap 100 relative to the beverage can 120. Further, the beverage can cap 100 may further preferably a flange-like grip formation as at 13 for enabling the user to more easily remove the beverage can cap 100 from the beverage can 120. The flange-like grip formation 13 may be preferably aligned with a select cap-turning nub 12 as exemplified by a posterior-most nub 12.

The beverage can cap 100 may further optionally comprise a stopper feature as at 24. The optional stopper feature 24 extends downwardly relative to the cap plate 20 for engaging a select aperture edge of the beverage-letting aperture 3 for preventing cap-to-can rotation past maximum open and maximum closed cap-to-can positions. The beverage can cap 100 may further preferably comprise a raised tab element cover as at 23, which raised tab element cover 23 extends upwardly from the cap plate 20 and is dimensioned for interiorly receiving a can-opening tab element as at 5 and exteriorly providing the user with visual alignment aid for aligning the beverage can cap 100 relative to the can-opening tab element 5.

In a second embodiment, the beverage can cap 200 according to the present invention preferably comprises an upper cap rim 15, a cap plate 20 centrally located relative to the cap rim 15, a cap opening 50 formed in the cap plate 20, and a cap plug as at 30. As with the beverage can cap 100, the beverage can cap 200 is removably and rotatably attachable to the upper can portion of the beverage can 120 such that the upper cap rim 15 receives the upper can rim 8 and the cap plate 20 extends in parallel relation to the can capping plate 7.

The beverage can cap 200 is optionally rotatable about a cap axis of rotation 110 for selectively positioning the cap plate 20 and the cap plug 30 in superior adjacency to a beverage-letting aperture 3 formable in the can capping plate 7 for selectively covering the beverage-letting aperture 3 with a portion of the cap plate 20. The cap plug 30 of beverage can cap 200 functions to selectively plug the beverage-letting aperture 3 and the cap opening 50. The cap plug 30 is preferably pivotally attached to the raised tab element cover 23A and removably retainable thereby via the mated engagement of elements 32 and 33 formed in the beverage can cap 200 as previously described.

In a third embodiment, the beverage can cap 300 according to the present invention preferably outfits a beverage can 120 for essentially and primarily enabling a user to resiliently control beverage flow from the beverage can 120. The beverage can cap 300 according to the present invention preferably comprises an upper cap rim 15, a cap plate 20 centrally located relative to the cap rim 15, and a resilient beverage-letting mechanism as at 41 coextensively formed with the cap plate 20.

The beverage can cap 300 is attachable to an upper can portion of the beverage can 120 such that the upper cap rim 15 receives an upper can rim as at 8, and the cap plate 20 extends in parallel relation to a can capping plate as at 7. The resilient beverage-letting mechanism 41 is resiliently actuable for forming a beverage-letting gap as at 50' and relaxable for closing the beverage-letting gap 50'. The resilient beverage-letting mechanism 41 thus enables the user to control beverage flow as at 108 via the beverage-letting gap 50' from the beverage can 120 as outfitted with the beverage can cap 300.

The beverage can cap 300 according to the present invention also preferably comprises a tab element cover as at 39, which tab element cover 39 extends upwardly from the cap plate 20 and is dimensioned for interiorly receiving a can-opening tab element 5. The tab element cover comprises a tab-engaging protrusion as at 32', which tab-engaging protrusion 32' is insertable into a tab element aperture 79 formed in the underlying can-opening tab element 5 for securing the tab element cover 39 to the can-opening tab element 5.

As prefaced above, it is contemplated that the tab element cover 39 of the third alternative beverage can cap 300 may optionally be of either a fixed or stationary (i.e. uncut) form as is the case with the first alternative beverage can cap 100 or of a pivotal (cut on three sides) form that translates in unison with the underlying can-opening tab element 5 as described hereinabove. In the former case scenario, the user may open the beverage can 120 (as the user would in connection with the first alternative beverage can cap 100) and attach the third alternative embodiment for selectively covering the beverage-letting aperture and/or controlling beverage flow 108 from the beverage can 120. The third alternative beverage can cap 300, however, preferably comprises a tab element cover 39 as shown in the appended drawings (i.e. cut on three sides and hinged). In this latter case scenario, there is no need to remove the third alternative beverage can cap 300 from the beverage can 120 to open the beverage can 120. The beverage can 120 may be opened with the third alternative beverage can cap 300 outfitted thereupon.

The resilient beverage-letting mechanism 41 is preferably pivotally attached to the cap plate 20 via laterally opposed living hinge mechanisms or hinges 43. The laterally opposed living hinge mechanisms or hinges 43 enhance resilient action of the beverage-letting mechanism 41. The beverage can cap 300, and beverage can caps 100 and 200, all preferably further comprise an inwardly extending cap groove as at 14 for engaging or cooperating with a can groove as at 17. The can groove 17 is positioned in inferior adjacency to the upper can rim 8 as part of the beverage can formation process. The inwardly extending cap groove(s) 14 are structurally cooperable with the can groove 17 for enhancing cap-to-can attachment.

Although the variously exemplified beverage can caps according to the present invention have been described by reference to a number of different embodiments, aspects, and features, it is not intended that the novel combinations or assemblies be limited thereby, but that modifications thereof are intended to be included as falling within the broad scope and spirit of the foregoing disclosure, the appended drawings, and the following claims.

What is claimed is:

1. A beverage can cap for outfitting a beverage can enabling a user to selectively cover an upper can portion of the beverage can, the upper can portion comprising an upper can rim, a can capping plate, and a neck portion, the beverage can cap comprising:

a lower cap skirt, an upper cap rim, a cap plate centrally located relative to the cap rim, a cap opening formed in the cap plate, and a raised tab element cover, the raised tab element cover comprising a tab-engaging protrusion, the beverage can cap being removably and rotatably attachable to the upper can portion of the beverage can such that the upper cap rim receives the upper can rim, the cap plate extends in parallel relation to the can capping plate, and the lower cap skirt seats down upon the neck portion, the beverage can cap being rotatable about a cap axis of rotation for selectively positioning the cap plate in superior adjacency to a beverage-letting aperture formable in the can capping plate for selectively covering the beverage-letting aperture with a portion of the cap plate, the raised tab element cover extending upwardly from the cap plate and being dimensioned for interiorly receiving a can-opening tab element, the tab-engaging protrusion being insertable into a tab element aperture formed in the can-opening tab element for securing the tab element cover to the can-opening tab element.

2. The beverage can cap of claim 1 wherein the neck portion extends obliquely relative to the can capping plate and the lower cap skirt extends obliquely relative to the cap plate, the lower cap skirt paralleling the neck portion.

3. The beverage can cap of claim 2 wherein the neck portion comprises an upper neck portion and a lower neck portion, the lower cap skirt comprising a skirt edge, the skirt edge terminating intermediate the upper and lower neck portions for enhancing safe use of the beverage can cap during cap rotation.

4. The beverage can cap of claim 1 comprising at least one cap-turning nub for enhancing a user's ability to rotate the beverage can cap relative to the beverage can.

5. The beverage can cap of claim 1 wherein the lower cap skirt comprises a grip formation, the grip formation for enabling the user to more easily remove the beverage can cap from the beverage can.

6. The beverage can cap of claim 1 comprising a stopper feature, the stopper feature extending downwardly relative to the cap plate for engaging a select aperture edge of the beverage-letting aperture for preventing cap-to-can rotation.

7. The beverage can cap of claim 1 wherein the raised tab element cover provides the user with a visual alignment aid for aligning the beverage can cap relative to the can-opening tab element.

8. The beverage can cap of claim 1 comprising an inwardly extending cap groove, the inwardly extending cap groove for engaging a can groove, the can groove being positioned in inferior adjacency to the upper can rim, the cap groove being cooperable with the can groove for enhancing cap-to-can attachment.

9. A beverage can cap for outfitting a beverage can enabling a user to selectively cover an upper can portion of the beverage can, the upper can portion comprising an upper can rim and a can capping plate, the beverage can cap comprising:

an upper cap rim, a cap plate centrally located relative to the cap rim, a cap opening formed in the cap plate, a cap plug, and a raised tab element cover, the raised tab element cover comprising a tab-engaging protrusion, the beverage can cap being attachable to the upper can portion of the beverage can such that the upper cap rim receives the upper can rim and the cap plate extends in parallel relation to the can capping plate, the beverage can cap being attachable to the upper can portion for selectively positioning the cap plate and cap plug in superior adjacency to a beverage-letting aperture formable in the can capping plate for selectively covering the beverage-letting aperture with the cap plate, the cap plug for selectively plugging the beverage-letting aperture and the cap opening, the raised tab element cover extending upwardly from the cap plate and being dimensioned for interiorly receiving a can-opening tab element, the tab-engaging protrusion being insertable into a tab element aperture formed in the can-opening tab element for securing the tab element cover to the can-opening tab element.

10. The beverage can cap of claim 9 wherein a can neck portion of the beverage can extends obliquely relative to the can capping plate and a lower cap skirt of the beverage can cap extends obliquely relative to the cap plate, the lower cap skirt paralleling the can neck portion.

11. The beverage can cap of claim 10 wherein the can neck portion comprises an upper neck portion and a lower neck portion, the lower cap skirt comprising a skirt edge, the skirt edge terminating intermediate the upper and lower neck portions for enhancing safe use of the beverage can cap.

12. The beverage can cap of claim 9 comprising at least one cap-turning nub for enhancing the user's ability to rotate the beverage can cap relative to the beverage can.

13. The beverage can cap of claim 9 wherein the raised tab element cover provides the user with a visual alignment aid for aligning the beverage can cap relative to the can-opening tab element.

14. The beverage can cap of claim 9 wherein the cap plug is pivotally attached to the raised tab element cover and removably retainable thereby.

15. The beverage can cap of claim 9 comprising an inwardly extending cap groove, the inwardly extending cap groove for engaging a can groove, the can groove being positioned in inferior adjacency to the upper can rim, the cap groove being cooperable with the can groove for enhancing cap-to-can attachment.

16. A beverage can cap for outfitting a beverage can enabling a user to resiliently control beverage flow from the beverage can, the beverage can cap comprising:

an upper cap rim, a cap plate centrally located relative to the cap rim, a resilient beverage-letting mechanism coextensively formed with the cap plate, and a tab element cover, the tab element cover comprising a tab-engaging protrusion, the beverage can cap being attachable to an upper can portion of the beverage can such that the upper cap rim receives an upper can rim and the cap plate extends in parallel relation to a can capping plate, the resilient beverage-letting mechanism being actuable for forming a beverage-letting gap and being relaxable for closing the beverage-letting gap, the tab element cover extending upwardly from the cap plate and being dimensioned for interiorly receiving a can-opening tab element, the tab-engaging protrusion being insertable into a tab element aperture formed in the can-opening tab element for securing the tab element cover to the can-opening tab element, the resilient beverage-letting mechanism thus for enabling the user to control beverage flow via the beverage-letting gap from the beverage can as outfitted with the beverage can cap.

17. The beverage can cap of claim 16 wherein the resilient beverage-letting mechanism is pivotally attached to the cap plate via laterally opposed hinge mechanisms, the laterally opposed hinge mechanisms for enhancing resilient action of the beverage-letting mechanism.

18. The beverage can cap of claim 16 comprising an inwardly extending cap groove, the inwardly extending cap groove for engaging a can groove, the can groove being positioned in inferior adjacency to the upper can rim, the cap groove being cooperable with the can groove for enhancing cap-to-can attachment.

* * * * *